US007798319B1

(12) United States Patent
Bried et al.

(10) Patent No.: US 7,798,319 B1
(45) Date of Patent: Sep. 21, 2010

(54) CONTAINER DEVICE FOR TOBACCO ARTICLES

(75) Inventors: David Karl Bried, Brentwood, TN (US); James Arthur Strickland, Goodlettsville, TN (US); Mark T. Nielsen, Madison, TN (US); Frank Scott Atchley, Nashville, TN (US); Lamar Eugene Walters, II, Brentwood, TN (US); Gregory A. Pace, Nunnelly, TN (US)

(73) Assignee: U.S. Smokeless Tobacco Company, Richmond, VA (US)

( * ) Notice: Subject to any disclaimer, the term of this patent is extended or adjusted under 35 U.S.C. 154(b) by 318 days.

(21) Appl. No.: 12/046,051

(22) Filed: Mar. 11, 2008

(51) Int. Cl.
*B65D 85/10* (2006.01)

(52) U.S. Cl. ..... 206/242; 206/265; 131/352; 215/307; 215/352; 220/366.1; 220/378

(58) Field of Classification Search ..... 206/242, 206/265, 270, 459.5; 131/352; 220/203.16, 220/310.1, 360, 366.1, 378, 796; 215/307, 215/321, 341, 348, 352, 45
See application file for complete search history.

(56) References Cited

U.S. PATENT DOCUMENTS

| | | | | | |
|---|---|---|---|---|---|
| 3,445,023 | A * | 5/1969 | Giessler et al. | ..... | 215/352 |
| 4,098,421 | A * | 7/1978 | Foster | ..... | 215/321 |
| 4,190,170 | A * | 2/1980 | Boyd | ..... | 215/307 |
| 4,646,933 | A * | 3/1987 | Jurczenia et al. | ..... | 220/366.1 |
| 5,443,853 | A | 8/1995 | Hayes | | |
| 5,686,127 | A * | 11/1997 | Stockley et al. | ..... | 220/378 |
| 5,752,599 | A * | 5/1998 | Veltman | ..... | 206/242 |
| 5,791,473 | A * | 8/1998 | Decker et al. | ..... | 206/407 |
| 6,170,490 | B1 * | 1/2001 | Barrow | ..... | 206/246 |
| D460,692 | S | 7/2002 | Cumberbatch | | |
| D464,886 | S | 10/2002 | Bried et al. | | |
| D476,572 | S | 7/2003 | Merritt | | |
| D510,524 | S | 10/2005 | Houk et al. | | |
| D512,636 | S | 12/2005 | Pace | | |
| D513,386 | S | 1/2006 | Pace et al. | | |
| D514,936 | S | 2/2006 | Pace et al. | | |
| D515,426 | S | 2/2006 | Pace et al. | | |
| D515,439 | S | 2/2006 | Pace et al. | | |
| D515,928 | S | 2/2006 | Pace | | |
| D523,752 | S | 6/2006 | Bried et al. | | |
| D531,036 | S | 10/2006 | Bried et al. | | |
| D541,176 | S | 4/2007 | Bried | | |
| 2006/0054626 | A1 * | 3/2006 | Delcroix et al. | ..... | 220/366.1 |

OTHER PUBLICATIONS

Sample images of Meguiar's Car Wax container (metal container and lid), manufactured by J. L. Clark (Rockford, IL), date unknown.
Sample images of rectangular metal container and lid, manufactured by Keenpack Industires, Ltd., date unknown.
Sample image of partial lid insert for canning jar (brand: Ball Regular Dome Lids), manufactured by Alltrista Corp. (Muncie, IN), date unknown.
Sample image of partial lid insert for canning jar (brand: Kerr Regular Mouth Lids for Preserving) distributed by Hearthmark LLC (Muncie, IN), date unknown.

* cited by examiner

*Primary Examiner*—Luan K Bui
(74) *Attorney, Agent, or Firm*—Fish & Richardson P.C.

(57) ABSTRACT

Some embodiments of a tobacco product package device can be used to enhance freshness and other characteristics of tobacco products or other products contained therein. Certain features can improve product freshness both during shelf life and during consumer use.

26 Claims, 11 Drawing Sheets

CONTAINER DEVICE FOR TOBACCO ARTICLES

TECHNICAL FIELD

This disclosure relates to packaging for consumable articles, for example, tobacco product package devices that can enhance product freshness and other characteristics of tobacco articles contained therein.

BACKGROUND

Some tobacco articles are packaged in containers that provide portability for the consumer. The containers may be configured to be repeatedly opened and closed for removal of selected portions of the tobacco articles over a period of time. For example, certain smokeless tobacco articles (e.g., including snuff tobacco) are packaged into containers that are commonly referred to as "cans" or "tins." Each of the containers may join with a lid to store the tobacco articles therein.

In some circumstances, the smokeless tobacco articles may be stored in a manner that permits excessive moisture migration into or out of the container. For example, particular moist snuff tobacco articles may be retained in containers in a manner that permits significant migration of moisture out of the containers during both the product shelf life and the period of consumer use. Such moisture egress from the container can cause the moist snuff tobacco to lose moisture and suffer a loss of freshness characteristics as well as negatively impact other desirable qualities of the tobacco product.

SUMMARY

Some embodiments of a tobacco product package device can be used to enhance freshness of tobacco products or other products contained therein. The tobacco product package device can include a gasket arranged between a container and a lid so as improve product freshness both during shelf life and during consumer use. The gasket may serve as a moisture barrier that retains a substantial portion of the moisture characteristics or other characteristics associated with the tobacco product freshness in the container. In particular embodiments, the gasket can provide a non-hermetic seal that provides only a limited amount of gas exchange with the ambient air, thereby permitting a portion of the gaseous pressure in the container (e.g., gases arising from biological or chemical changes of organic products stored in the container) and permitting entrance of a limited amount of oxygen and other ambient gases into the package device.

In particular embodiments, a tobacco product package device may include a polymeric container having a bottom wall, a generally cylindrical side wall that extends in an axial direction from the bottom wall toward a connection rim, and a top opening that is at least partially defined by the connection rim. The polymeric container may define an interior space that is in communication with the top opening. The device may also include a moist snuff tobacco product arranged in the interior space of the polymeric container. The device may further include a metallic lid that releasably engages the polymeric container to enclose the moist snuff tobacco product in the interior space. The metallic lid may include a lid wall that is integral with a skirt. The skirt may provide a snap-fit engagement with connection rim. The device may also include a resilient gasket affixed to an interior surface of the lid wall to provide a moisture barrier and a non-hermetic seal between the metallic lid and the polymeric container when the metallic lid is releasably engaged with the polymeric container.

In some embodiments, a tobacco product package device may include a container defining an interior space and having a bottom wall, a generally cylindrical side wall that extends from the bottom wall toward a connection rim. The device may also include a tobacco product tobacco product for oral consumption arranged in the interior space of the container. The device may further include a lid that encloses the tobacco product in the interior space of the container. The lid may include a lid wall that is integral with a skirt. The skirt can be releasably engaged with connection rim. The device may also include a resilient gasket in engagement with an interior surface of the lid wall to provide a moisture barrier and a non-hermetic seal between the lid and the container when the lid is secured to the container. The resilient gasket may abut with the connection rim of the container when the lid is secured to the container. The moisture barrier can inhibit the migration of moisture to and from the container when the lid is secured to the polymeric container. The non-hermetic seal permits gas exchange between ambient air and the interior space when the lid is secured to the container.

Some embodiments described herein include a method of packaging a tobacco product. The method may include forming a tobacco product container having an interior space that is at least partially defined by a bottom wall, a generally cylindrical side wall, and a top opening. The method may also include forming a lid that includes lid wall integral with a circumferential skirt. The skirt may provide a releasable engagement with a connection rim of the tobacco product container when the lid is releasably engaged with the tobacco product container. The method may further include affixing a resilient gasket to an interior surface of the lid wall proximate to the skirt. The method may also include depositing a predetermined amount of an orally consumable tobacco product in the interior space of the tobacco product container. The method may further include securing the lid to the connection rim of the tobacco product container so that the resilient gasket abuts the connection rim between the lid and the container to form a moisture barrier for the snuff tobacco product enclosed in the interior space.

Some embodiments described herein include a method of operating a tobacco product package device. The method may include obtaining a tobacco product package device in a closed condition. The package device can include: a generally cylindrical container defining an interior space that is in communication with a top opening, a snuff tobacco product arranged in the interior space of the container, a lid having a lid wall integral with a skirt that is releasably engaged with a connection rim of the container, and a resilient gasket affixed to an interior surface of the lid wall and abutting the connection rim of the container. The method may also include releasing the lid from the container to adjust the tobacco product package device to an opened condition. The method may further include removing a portion of the snuff tobacco product from the interior space of the container while the tobacco product package device is in the opened condition. The method may also include reengaging the lid with the connection rim of the container to return the tobacco product package device to the closed condition. The resilient gasket affixed to the lid wall may abut the connection rim of the container to provide a moisture barrier for the snuff tobacco product that remains in the interior space of the container.

Some of the embodiments described herein may provide one or more of the following advantages. First, the tobacco product package device can be used to store an orally consumed tobacco product (e.g., a snuff tobacco product such as moist snuff tobacco) in a manner that enhances the product freshness for the end consumer. For example, the tobacco product package device can be used to store a moist snuff tobacco product in a manner that retains a substantial portion of the moisture characteristics of the tobacco product. As such, the moist snuff tobacco product maintains its moistness over a greater period of time, thereby enhancing the product freshness and satisfaction for the end consumer. In another example, the tobacco product package device can be used to store a dry tobacco product in a manner that inhibits ingress of moisture from the ambient surrounding into the container.

Second, the tobacco product package device can be used to enhance the product freshness both during the product shelf life and during the period of consumer usage. In particular, the tobacco product package device may be equipped with a gasket feature that provides a moisture barrier when the tobacco product is packaged and stored throughout the product shelf life. Thus, in the embodiment in which the container stores a moist snuff tobacco product, a substantial portion of the moisture characteristics are maintained throughout the shelf life period. After the period of shelf life, the tobacco product package device is opened by a consumer for removal and consumption of a portion of the tobacco product. When the tobacco product package device is returned to a closed condition (e.g., the lid is mated with the container), the gasket again serves as a moisture barrier for the remaining tobacco product. Accordingly, the tobacco product package device can be used to maintain the product freshness and other characteristics both during the product shelf life and during the period of consumer usage.

Third, the gasket of the tobacco product package device can be arranged between a container and a lid to provide a non-hermetic seal. In such circumstances, the non-hermetic seal can provide a limited amount of gas exchange with the ambient air while maintaining control over the egress of moisture, volatile flavors, or both (from the orally consumed tobacco product) out of the container. For example, in some embodiments, the container may retain some natural organic products that can at least partially change (biologically or chemically) during the product shelf life (when the lid is not opened), thereby raising the gaseous pressure in the container. The tobacco product package device can provide the non-hermetic seal so that at least some of the evolved gases can escape from the container to relieve the pressure therein. In addition, the non-hermetic seal may permit a limited amount of air (e.g., including oxygen) to ingress into the container, thereby reducing oxidation of the material therein. Thus, the gasket can provide a limited amount of gas exchange (e.g., egress of evolved gases and ingress of oxygen) that permits the natural organic products to "breath" and thereby reduce the likelihood of non-optimal flavors observed sometimes during usage. Moreover, the gasket can provide the aforementioned gas exchange while continuing to provide the moisture barrier for improved control over the egress of moisture from the moist snuff tobacco product (or the ingress of moisture into the dry tobacco products).

Fourth, the container of tobacco product package device may include one or more vent structures arranged proximal to the region that joins with the lid. The vent structures can be used to at least partially control the limited gas exchange provided by the non-hermetic seal.

Fifth, the components of the tobacco product package device (such as the gasket, the lid, and the container) can be manufactured using methods that provide high reliability at reduced costs. In some embodiments, the gasket can be formed and affixed to the lid in a high-speed manner that is suitable for mass production of the tobacco product package device.

In addition to the exemplary aspects and embodiments described above, further aspects and embodiments will become apparent by reference to the drawings and by study of the following descriptions. The details of one or more embodiments of the invention are set forth in the accompanying drawings and the description below. Other features, objects, and advantages will be apparent from the description and drawings, and from the claims.

DESCRIPTION OF DRAWINGS

Exemplary embodiments are illustrated in the referenced figures of the drawings. It is intended that the embodiments and figures disclosed herein are to be considered illustrative rather than limiting.

Like reference symbols in the various drawings indicate like elements.

DETAILED DESCRIPTION OF ILLUSTRATIVE EMBODIMENTS

Figure 1A:
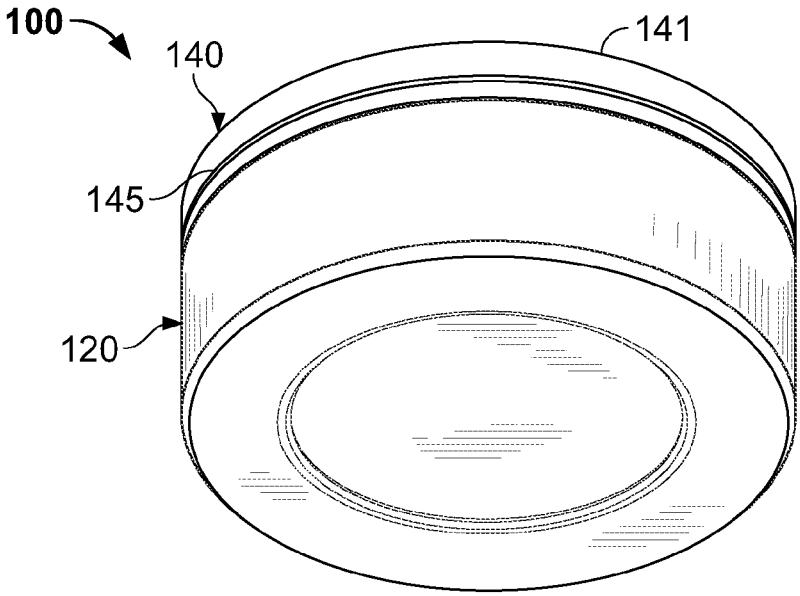
FIGS. 1A-C are perspective views of a tobacco product package device, in accordance with some embodiments.
Figure 1B:
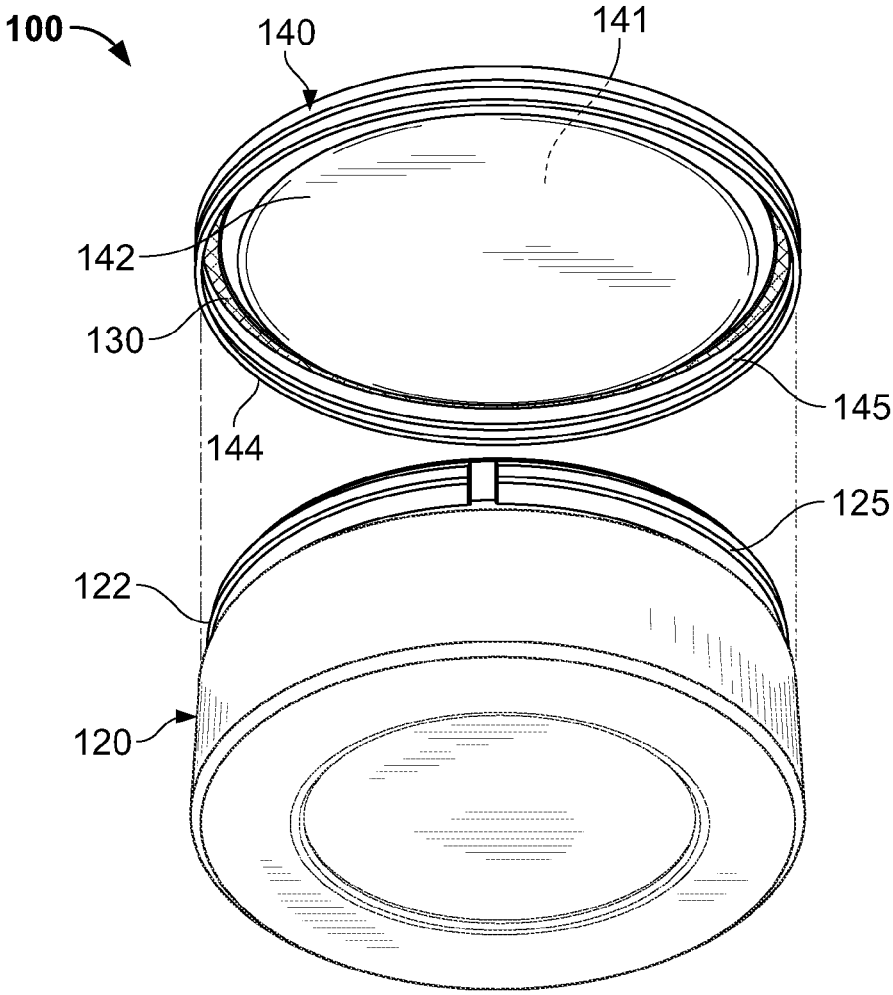
Figure 1C:
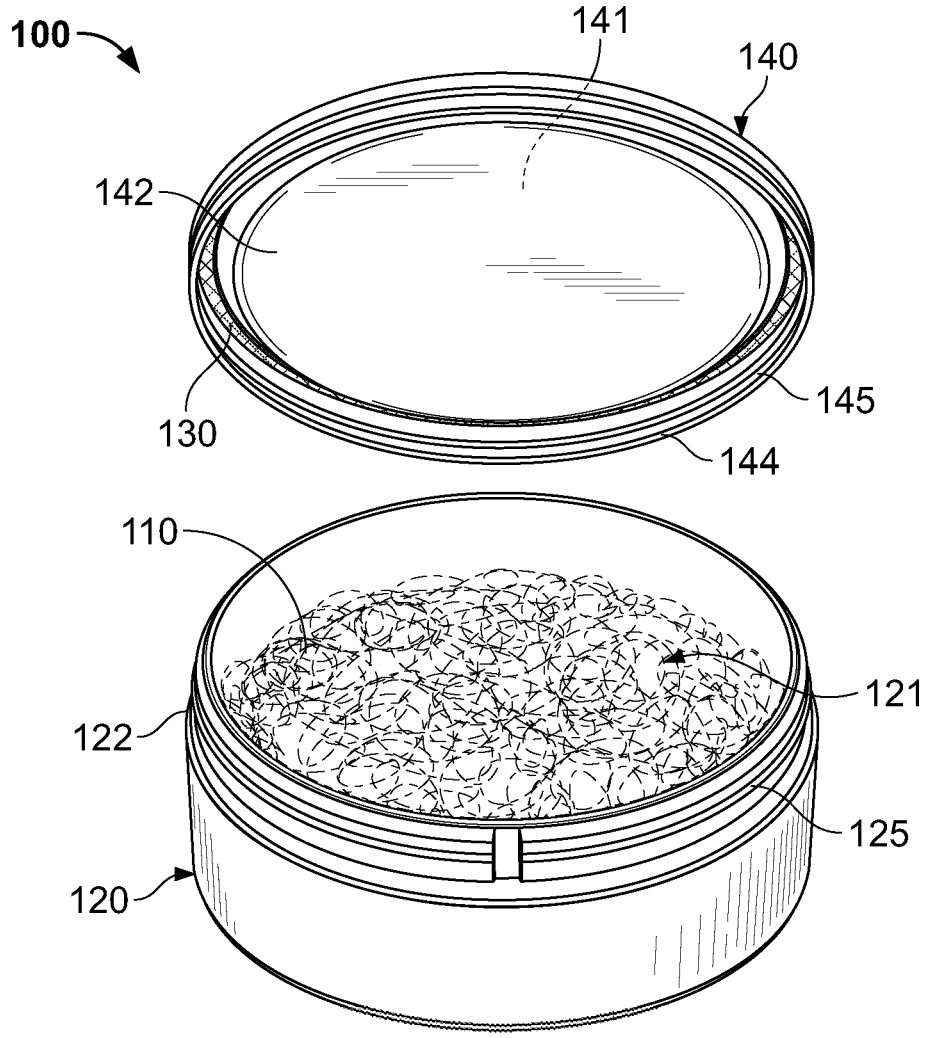

Referring to FIGS. 1A-C, some embodiments of a tobacco product package device 100 can be used to maintain or enhance freshness and other product qualities of tobacco products (e.g., chewing tobacco, moist snuff tobacco (loose, pouch, or other articulations), dry snuff tobacco, or other smokeless tobacco products for oral consumption) contained therein. Such qualities may relate to, without limitation, texture, flavor, color, aroma, mouth feel, taste, ease of use, and combinations thereof. The tobacco product package device 100 can include a gasket 130 arranged between a container 120 and a lid 140 so as improve product freshness during both shelf life and consumer use. The gasket 130 may serve as a moisture barrier that limits the egress of the moisture from the container 120 (or the ingress of the moisture into the container 120) when the lid 140 is joined with the container 120. In some circumstances, the gasket 130 may provide a non-hermetic seal that provides a limited amount of gas exchange with the ambient air (e.g., to permit venting of evolved gases or the like), as described in more detail below.

The container 120 and lid 140 are matable with one another so that the package device 100 can be closed and thereby retain the tobacco products therein (refer, for example, to the moist snuff tobacco 110 illustrated in FIG. 1C). In this embodiment, the container 120 has a generally cylindrical shape and includes a base and a cylindrical side wall that at least partially defines an interior space 121 (FIG. 1C). The container 120 may comprise a material such as a polymer (e.g., polypropylene or the like), fiberboard, or metallic material that is suitable for storing tobacco products having one or more flavorants or volatile agents. In this embodiment, the container 120 comprises a moldable polymer material. As shown in FIG. 1A, the package device 100 can be arranged in a closed condition so that the container 120 has a snap-fit engagement with the lid 140. Alternatively, the container 120 can be configured to have a slide-lock engagement with the lid 140.

The lid 140 may comprise a metallic material (e.g., aluminum, tin, stainless steel, or the like) that is suitable for bonding, adhering, or otherwise affixing to the gasket 130. Alternatively, the lid 140 can be formed from a moldable polymer material such as polypropylene or the like. The lid 140 includes a lid wall 141 and a skirt 144 that extends from the circumference of the lid wall 141. In this embodiment, the skirt 144 includes a second bead 145 that mates with the container 120 to releasably retain the lid 140 to the container 120, thereby enclosing the snuff tobacco 110 or other tobacco products in the closed package device 100.

Still referring to FIGS. 1A-C, the container 120 includes a connection rim 122 that includes a first bead 125 (such as a locking ring depicted in FIG. 1B) to mate with the second bead 145 of the lid 140. The connection rim 122 can be integrally formed as part of the cylindrical side wall of the container 120. As shown in FIG. 1B, the gasket 130 can be affixed to an inner lid surface 142 so that the gasket 130 is position between the lid wall 141 and the connection rim 122 when the lid 140 mates with the container 120. As such, the metallic lid 140 of this embodiment can be press-fit with the polymeric container 120 so that the second bead 145 mates with the first bead 125 of the container 120, thereby urging the lid wall 141 toward the container 120. Because the lid wall 141 is urged toward the container 120, the gasket 130 can be at least partially compressed between the metallic lid 140 and the polymeric container 120 when the package device is in the closed condition. In this embodiment, the gasket 130 includes a ring-shaped structure arranged on the inner lid surface 142 so as to abut against a connection rim 122 of the container 120. The gasket 130 comprises a generally resilient material that is affixed to the inner lid surface 142. For example, in this embodiment, the gasket 130 may comprise a plastisol composition that is formed into a ring of film along the inner lid surface 142. In alternative embodiments, the gasket 130 may comprise another material, such as a urethane material, an epoxy material, or a wax material.

The gasket 130 of the package device 100 can serve as a moisture barrier to inhibit the egress of moisture from the package device 100 (and likewise to inhibit the ingress of moisture into the package device 100). For example, in this embodiment the container 120 stores a moist snuff tobacco product 110, and the gasket 130 can provide a barrier that inhibits the migration of moisture from the moist snuff tobacco product 110 and out the package device. Such a feature can improve the product freshness of the tobacco products that are enclosed in the tobacco product package device 100. Moreover, the gasket 130 can be configured to provide a non-hermetic seal that permits a limited amount of gas exchange with the ambient air while maintaining control over the egress of moisture (from the moist snuff tobacco product 110) out of the container 120. For example, some natural organic products in the snuff tobacco 110 are sometimes susceptible to biological or chemical changes during the product shelf life (before the lid 140 is separated from the container 120 for consumer use). Such biological or chemical changes may create byproduct gases, and the non-hermetic seal provided by the gasket 130 permits at least some of the byproduct gases to escape from the container 120. In addition, the non-hermetic seal may permit a limited amount of oxygen to ingress into the container. Thus, the gasket can provide a limited amount of gas exchange (e.g., egress of evolved gases and ingress of oxygen) to thereby reduce the likelihood of a non-optimal flavor for the tobacco product.

Still referring to FIGS. 1A-C, the container 120 and lid 140 can be separated from one another so as to shift the package device 100 to an opened condition (shown, for example, in FIG. 1C). When the package device 100 is in the opened condition, a consumer can have access to the tobacco product contained therein (e.g., snuff tobacco 110 in this particular embodiment). For example, as shown in FIG. 1C, the consumer may remove the lid 140 from the container 120 by overcoming the snap-fit engagement between the skirt 144 and the connection rim 122. Thereafter, the consumer can obtain a portion of the snuff tobacco product 110 for personal usage by accessing the top opening of the container 120. The remaining portion of the snuff tobacco product 110 can be enclosed in the package device 100 when the lid 140 is reengaged with the container 120. When the tobacco product package device 100 is returned to the closed condition, the gasket 130 returns to an abutting relationship with the connection rim 122 of the container 120.

Accordingly, the gasket 130 can serve as a moisture barrier to enhance the product freshness and other characteristics not only during the product shelf life, but also during the period of consumer use (e.g., after the tobacco product package is opened and then closed by the consumer). As previously described, in those embodiments in which the container 120 retains the moist snuff tobacco product 110, a substantial portion of the moisture characteristics are maintained throughout the shelf life period. However, after the period of shelf life, the tobacco product package device 100 is opened by a consumer for removal and consumption of a portion of the tobacco product 110. When the tobacco product package device 100 is returned to a closed condition (e.g., the lid 140 is mated with the container 120 as shown in FIG. 1A), the gasket 130 again serves as a moisture barrier for the remaining tobacco product 110. In such circumstances, the tobacco product package device 100 can be used to improve the product freshness both during the product shelf life and during repeated uses of opening and closing the package device 100.

Although the particular embodiment depicted in FIGS. 1A-C illustrate the tobacco product in the package device 100 as being a moist snuff tobacco product, it should be understood from the description herein that any one of a number of tobacco products can be retained in the package device 100. For example, the tobacco product arranged in the package device 100 may comprise chewing tobacco, dry snuff tobacco, moist snuff tobacco (loose, pouch, or other articulations), or another smokeless tobacco product. The tobacco product can include tobacco that is whole, shredded, cut, cured, aged, fermented, pasteurized, pouched, or otherwise processed. In some embodiments, the tobacco contained in the package device 100 may include portions of leaves, flowers, roots, stems, or extracts thereof of any member of the genus *Nicotiana*. Further, the tobacco may include an extract of tobacco that provides additional tobacco constituents (e.g., flavors, aromas, alkaloids, or the like). In some embodiments described herein, the tobacco product may include one or more components such as flavor extracts, flavor masking agents, bitterness receptor site blockers, receptor site enhancers, sweeteners, and additives such as chlorophyll, minerals, botanicals, or breath-freshening agents.

In the embodiment depicted in FIGS. 1A-C, the tobacco product comprises a smokeless tobacco for oral consumption in the form of moist snuff tobacco 110 (FIG. 1C). Such moist snuff tobacco 110 may comprise shredded or cut tobacco that is processed to have substantial moisture content. For example, the moist snuff tobacco 110 may comprise a moisture content at final packaging of about 40% by weight or greater, about 45% by weight to about 65% by weight, about 50% to about 60% by weight, and in this embodiment about 55% by weight.

Figure 2:
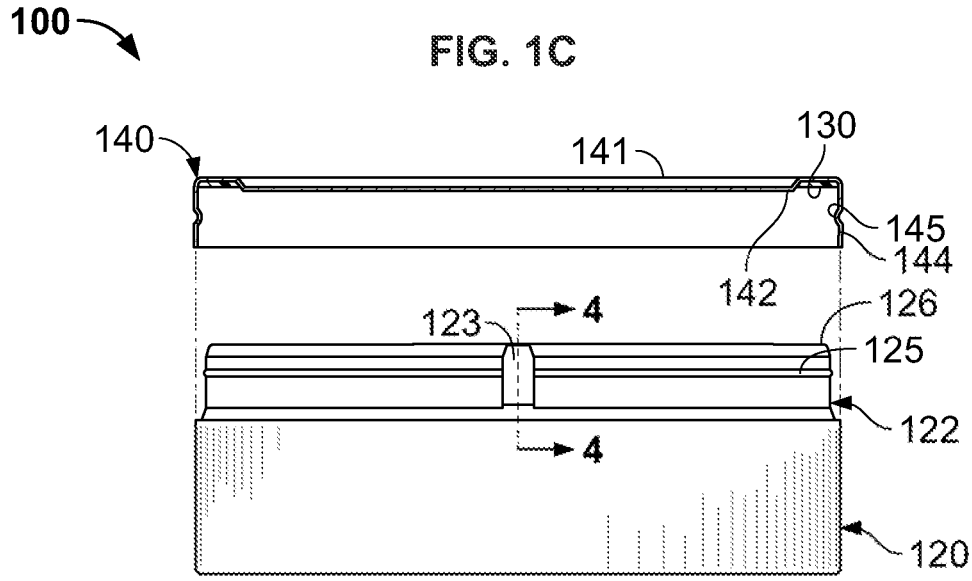
FIG. 2 is a section view of the tobacco product package device of FIGS. 1A-C.

Referring now to FIG. 2, some embodiments of the package device 100 may include one or more vent structures 123 arranged to at least partially control of the limited gas exchange provided by the non-hermetic seal. The vent structures 123 can be positioned proximate the connection rim 122 that mates with the lid 140. In this embodiment, each of the vent structures 123 comprises an indentation formed in the connection rim 122 of the container 120. The indentation interrupts the first bead 125 of the connection rim 122 and extends toward an upper rim face 126 (refer to both FIG. 2 and FIG. 4). Thus, in this embodiment, the first bead 125 of the connection rim 122 has a discontinuous configuration (due to the vent structures 123) while the second bead 145 of the lid skirt 144 is generally continuous. In such circumstances, the second bead 145 of the lid skirt 144 does not fully engage the connection rim 122 in the areas of the vent structures 123, which facilitates a limited exchange of gases pass the gasket 130.

The vent structures 123 provide a path for gas exchange between the ambient air and the gasket-container interface (e.g., the interface between the gasket 130 and the container 120 in this embodiment). For example, when the lid 140 is mated with the container 120, some evolved gases may pass from inside the container 120, pass the gasket 130, and out of the vent structures 123 (toward the ambient surroundings). In another example, when the lid 140 is mated with the container 120, oxygen or other ambient gases can pass through the vent structures 123, pass the gasket 130, and into the container 120. The vent structures 123 can be selected to at least partially control the amount of gas exchange. In particular, the number of vent structures 123 or the size of the vent structures 123 can be increased to promote a greater level of gas exchange. Alternatively, the number of vent structures 123 or the size of the vent structures 123 can be decreased to reduce the amount of gas exchange.

In addition, the vent structures 123 can be used to facilitate the snap-fit engagement between the container 120 and the lid 140. When the lid 140 is pressed unto the connection rim 122 of the container, the second bead 145 of the lid skirt 144 can mate with the first bead 125 of the container 120 so as to snap into the releasable engagement. As the second bead 145 is pressed over the first bead 125, some air can escape out of the vent structure 123 to reduce the likelihood of trapping excessive air inside the container 120 (e.g., which may otherwise lead to excessive pressure that urges the lid 140 to disengage the container 120).

Figure 3:
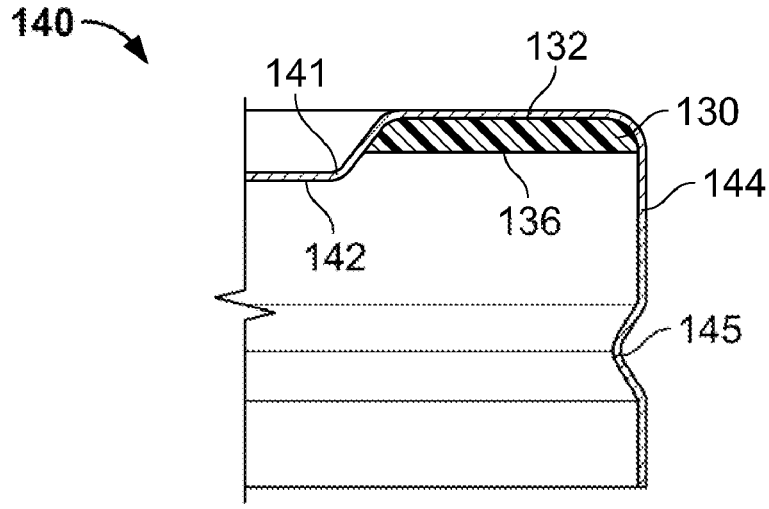
FIG. 3 is a partial cross-sectional view of a lid and gasket of the tobacco product package device of FIGS. 1A-C.
Figure 4:
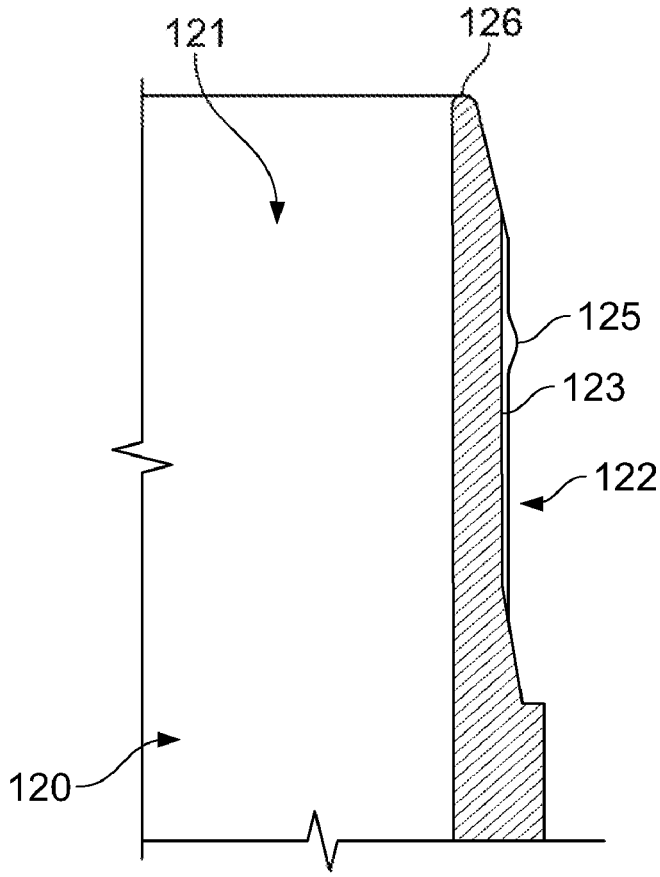
FIG. 4 is a partial cross-sectional view of a container of the tobacco product package device of FIGS. 1A-C.

Referring now to FIGS. 3-4, the gasket 130 can be affixed to the inner lid surface 142 so that it engages the upper rim face 126 when the lid 140 is joined to the container 120. As previously described, the gasket 130 can be formed as a ring of resilient material (e.g., plastisol in this embodiment) that is affixed to the inner lid surface 142. As shown in FIG. 3, the gasket 130 includes first surface 132 that is bonded or otherwise affixed to an interior channel defined by the inner lid surface 142. The gasket 130 also includes a second surface 136 arranged opposite of the first surface 132. The second surface 136 is configured to abut with the upper rim face 126 of the container 120 when the lid skirt 144 mates with the connection rim 122.

Accordingly, the gasket 130 can provide a resilient structure that provides a moisture barrier between the polymeric container 120 and the metallic lid 140 in this embodiment. As previously described, the moisture barrier can be used to provide desirable qualities of the tobacco product (e.g., the moist tobacco snuff 110 depicted in FIG. 1C) contained in the package device 100. For example, the gasket 130 can provide improved control over the egress of moisture from the closed package device 100 as compared to other embodiments without a gasket between the lid and the container. Also, as previously described, the gasket 130 can serve as a moisture barrier for the package device 100 while also providing a non-hermetic seal that permits a limited amount of gas exchange with the ambient air. Such a configuration can provide enhanced product freshness (e.g., reducing the likelihood of the tobacco product from being overly dried or overly moistened) and reliable product flavoring (e.g., reducing the likelihood of non-optimal flavors from trapped byproduct gases).

Figure 5A:
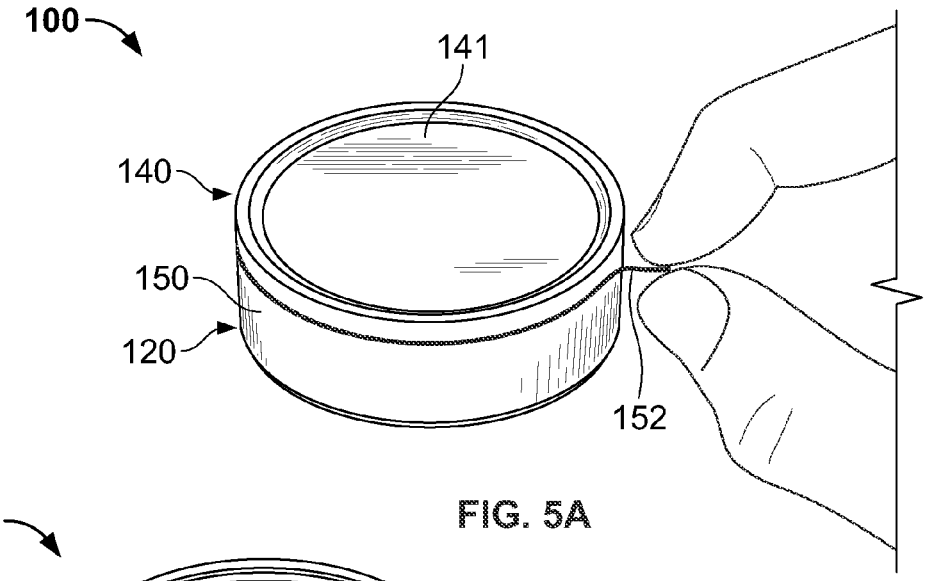
FIGS. 5A-C are perspective views showing consumer use of a tobacco product package device, in accordance with some embodiments.
Figure 5B:
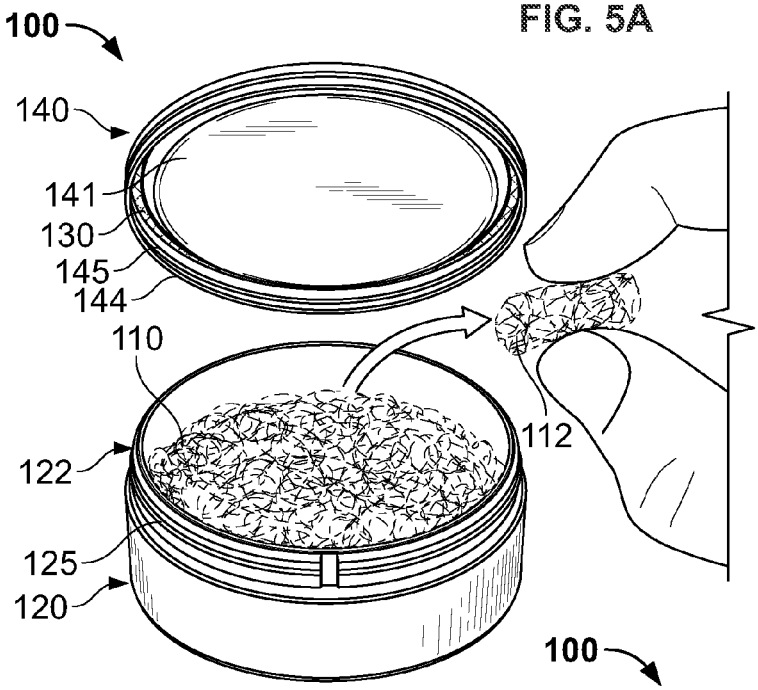
Figure 5C:
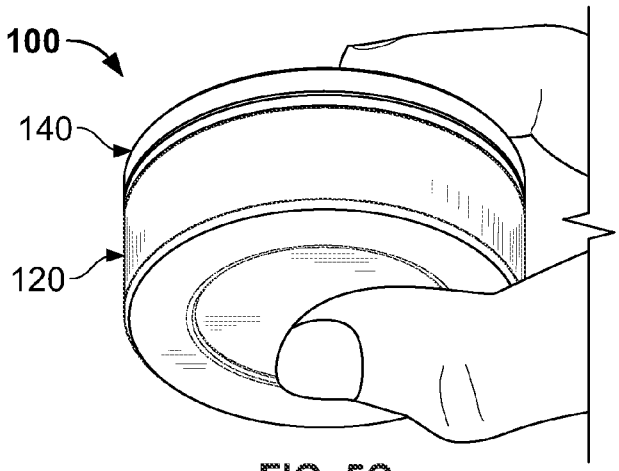

Referring to FIGS. 5A-C, in use, the tobacco product package device 100 can store the tobacco product (e.g., snuff tobacco 110 in this particular embodiment) in conditions that enhance the product freshness. As previously described, such storage conditions can be provide both during the product shelf life and during the period of consumer use.

In the particular embodiment shown in FIG. 5A, the tobacco product package device 100 can include a side label 150 that secures the container 120 and lid 140 together during the product shelf life. The side label may comprise a paper label having an adhesive backing that retains the lid 140 in the closed condition (e.g., mated with the container 120). The side label 150 can include a tear strip 152 that extends along the circumference of the package device 100 so that a consumer can pull upon the tear strip 152 to facilitate opening of the package device 100. Alternatively, the side label 150 can include a score line or other structure that facilitates separation of the side label 150 at a region near the interface of the container 120 and the lid skirt 144.

In some embodiments, the side label 150 may also serve as a supplemental moisture barrier during the product shelf life. For example, the side label 150 may comprise a polymer film that seals the exterior interface between the lid 140 and the container 120. Such a polymer film seal label can impede the ingress or egress of moisture therethrough, thereby preserving the product freshness of the snuff tobacco 110 or other tobacco products contained in the package device 100. It should be understood that in these embodiments, the polymer film seal label may not permit the limited gas exchange for venting byproduct gases (depending on the particular gases involved). However, such a side seal label can be effective for tobacco product package devices 100 in circumstances where the product does not biologically or chemically change (e.g., where the product shelf life is short, where the tobacco products have little or no natural products that are likely to undergo biological or chemical changes, or other like circumstances).

As shown in FIG. 5B, the consumer can separate the lid 140 from the container 120 so that the tobacco product package device 100 is in the opened condition. With the lid 140 removed, the consumer can access the tobacco product 110 stored in the container 120. For example, in this embodiment the container 120 is used to store a moist snuff tobacco 110, and the consumer can pinch a portion 112 of the snuff tobacco for personal usage while the remaining portion of the snuff tobacco 110 is retained in the container 120. As previously described, the tobacco product package device 100 includes the gasket 130 affixed to the inner lid surface 142. When the lid 140 is returned to the closed condition, the gasket 130 can serve as a moisture barrier to inhibit the egress of moisture from the package device 100 (and likewise to inhibit the ingress of moisture into the package device 100). Moreover, the gasket 130 can be configured to provide a non-hermetic seal that permits a limited amount of gas exchange with the ambient air while maintaining control over the egress of moisture (from the moist snuff tobacco product 110) out of the container 120.

As shown in FIG. 5C, after the consumer obtains a portion of the tobacco product 110, the consumer can return the tobacco product package device 100 to the closed condition. For example, the user can press the lid 140 over the connection rim 122 of the container 120 to reengage the lid 140 with the container 120 and to thereby enclose the remaining tobacco product 110 in the package device 100. When the tobacco product package device 100 is returned to the closed condition, the gasket 130 (FIG. 5B) returns to an abutting relationship with the connection rim 122 of the container 120. Therefore, the gasket 130 can serve as a moisture barrier to enhance the product freshness both during the product shelf life (refer, for example, to FIG. 5A) and during the period of consumer use (refer, for example, to FIG. 5C).

Figure 6:
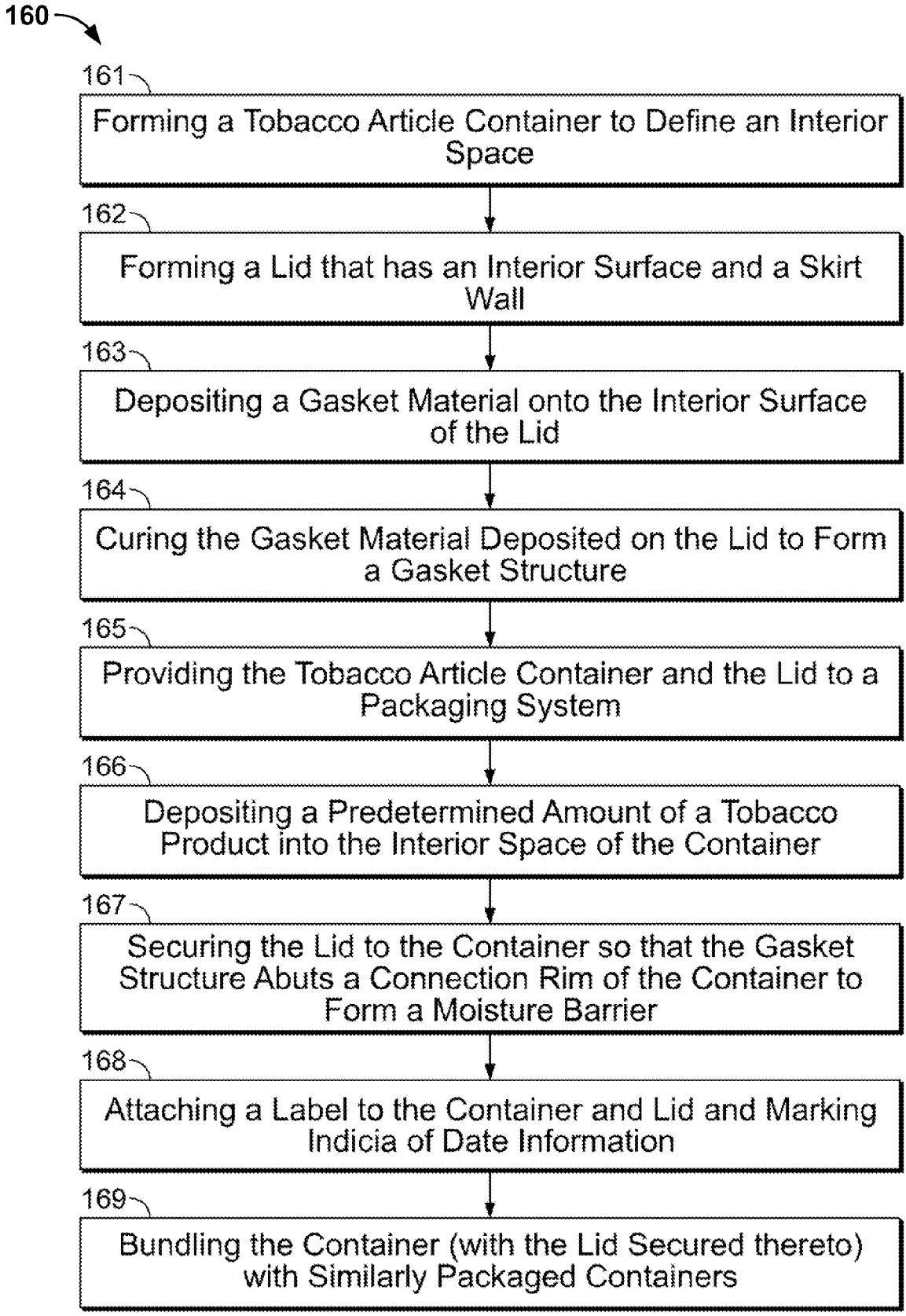
FIG. 6 is a diagram of a process for manufacturing a tobacco product package device, in accordance with some embodiments.

Referring now to FIG. 6, the tobacco product package device 100 can be manufactured using methods that provide high reliability and cost efficiency. In particular, certain embodiments are suitable for mass production in a manner that provides consistent freshness characteristics for the snuff tobacco or other tobacco products contained therein. In this embodiment, a process 160 for packaging tobacco products includes an operation 161 of forming a tobacco product container (e.g., container 120 depicted in FIGS. 1A-2 and 4) to define an interior space that is accessible through an opening. The opening of the container 120 can be defined by the connection rim 122. The container 120 may comprise a material such as a polymer material (e.g., polypropylene or the like), fiberboard, or metallic material that is suitable for storing tobacco products. In this embodiment, the container 120 comprises a moldable polymer material (e.g., polypropylene or the like) so that the container 120 can be formed using an injection molding operation. Such a forming technique can be used to mass produce the container 120 with the desired geometries and surface features in a relatively low-cost manner. In other embodiments, the container 120 may comprise a fiberboard material or metal material such as aluminum, tin, stainless steel, or the like.

The process 160 may also include an operation 162 of forming a lid (e.g., lid 140 depicted in FIGS. 1A-3) that has an interior surface 142 and skirt wall 144. In this embodiment, the lid 140 is formed from a metal material (e.g., aluminum, tin, stainless steel, or the like). As such, the lid 140 can be formed, for example, using a stamping process that deforms a metallic work piece into the desired shape including the lid wall 141 (having the interior surface 142) and the skirt 144. As previously described in connection with FIGS. 2-4, the skirt wall 144 can include the second bead 145 that facilitates the snap-fit engagement with the connection rim 122 of the container 120.

Still referring to FIG. 6, the process 160 also includes one or more operations for forming the gasket (e.g., the gasket 130 depicted in FIGS. 1B-1C and 3). For example, the process 160 can include an operation 163 of depositing a gasket material on the interior surface 142 of the lid 140. The gasket material can include a polymer composition that is applied in a liquid state and thereafter transitions to a resilient material. In this embodiment, the gasket material comprises a plastisol composition that is injected or poured (hot or cold) into an outer perimeter channel of the interior surface 142 of the lid 140. The plastisol composition may comprise a fluid dispersion of a polyvinyl chloride resin. Such a liquid deposition process can be performed at rapid speeds to facilitate mass production of the tobacco product package devices 100. Alternatively, the gasket material (deposited in a liquid state) may comprise a two-part urethane, an epoxy, a wax composition, or the like.

In these circumstances, the process 160 may include an operation 164 of curing the gasket material that was deposited onto the lid 140 so as to form a gasket structure (refer, for example, to the gasket 130 depicted in FIGS. 1B-1C and 3). This operation 164 can be accomplished using an oven-curing process in which the lid 140 and gasket material are delivered through an oven for exposure to an elevated temperature. Alternatively, the gasket material can be cured at ambient air temperature. When the gasket material cures, the structure solidifies to provide the resilient gasket 130 affixed to the lid 140. In some embodiments, the gasket material can be compression molded to provide a desired profile or shape to the gasket. For example, the gasket material can be partially cured in an oven-curing process or an air-curing process before a compression die is urged into contact with the exposed surface of the gasket material. The compression die acts upon the gasket material to shape the gasket into a desired profile or geometry. After the compression die has acted upon the gasket material, the gasket material can be fully cured in a subsequent oven-curing process or an air-curing process.

Still referring to FIG. 6, in this embodiment the process 160 includes an operation 165 of providing the tobacco product container and the lid to a packaging system. For example, the formed container 120 and the formed lid 140 (having the gasket 130 affixed thereto) can be input into a packaging system that conveys the components to a particular location for delivery of a tobacco product into the container 120. In addition, the process 160 includes an operation 166 of depositing a predetermined amount of a tobacco product into the interior space 121 of the container 120. The container 120 can be conveyed to portioning mechanism that delivers a selected portion of a tobacco product from a bin and into the container 120. In this embodiment, the tobacco product comprises a snuff tobacco, such as a moist snuff tobacco product 110 depicted in FIGS. 1C and 5B.

The process 160 also includes an operation 167 of securing the lid 140 to the container 120 so that the gasket 130 abuts the connection rim 122 of the container 120. When the lid 140 is secured to the container 120 as previously described, the gasket 130 forms a moisture barrier for the tobacco product package device 100 so as to inhibit the egress of moisture from the package device 100 (and likewise to inhibit the ingress of moisture into the package device 100).

Still referring to FIG. 6, the process 160 can include an operation 168 of attaching a label to the container 120 and lid 140. For example, the operation 168 may include a labeler mechanism that affixes a side label 150 to the outer circumferential surface of the container 120 and the lid skirt 144. As previously described in connection with FIG. 5A, the side label 150 can be used to retain the container 120 and lid 140 together during transport and during the product shelf life. The side label may comprise a paper label having an adhesive backing that retains the lid 140 in the closed condition (e.g., mated with the container 120). In alternative embodiments, the side label 150 may comprise a polymer film that seals that the exterior interface between the lid 140 and the container 120. Such a polymer side seal can provide a supplemental moisture barrier during the product shelf life that impedes the ingress or egress of moisture therethrough, thereby preserving the product freshness of the moist tobacco snuff 110 or other tobacco products contained in the package device 100.

The operation 168 may also include providing indicia of date and trace information, such as a packaging date, an expiration date, or a combination thereof. The date information can be printed onto the container 120, the lid 140, or the side label 150 so that the date and trace information is viewable to a consumer. In some embodiments, the date and trace information may comprise the packaging date to indicate when the tobacco product was packaged into the container.

Still referring to FIG. 6, the process 160 may include an operation 169 of bundling the container 120 (with the lid 140 secured thereto) with similarly packaged containers 120. For example, the process 160 can be used to form a plurality of the tobacco product package devices 100 that include tobacco product enclosed inside containers 120 with lids 140 secured thereto. The plurality of tobacco product package devices 100 can be formed using the previously described operations to facilitate mass production at relatively high speeds. When a tobacco product package device 100 is formed, it can be bundled with other tobacco product package devices 100, for example, in a sleeve or in a box for distribution. In this embodiment, the plurality of tobacco product package devices 100 are bundled on top of one another in a sleeve (e.g., a shrink-wrapped sleeve) so as to provide a generally cylindrical package for shipment.

Accordingly, the tobacco product package devices 100 can be manufactured using methods that provide high reliability and cost efficiency. The operations for forming the tobacco product package devices 100 can provide consistent results for maintaining the freshness of the tobacco products stored therein.

Figure 7A:
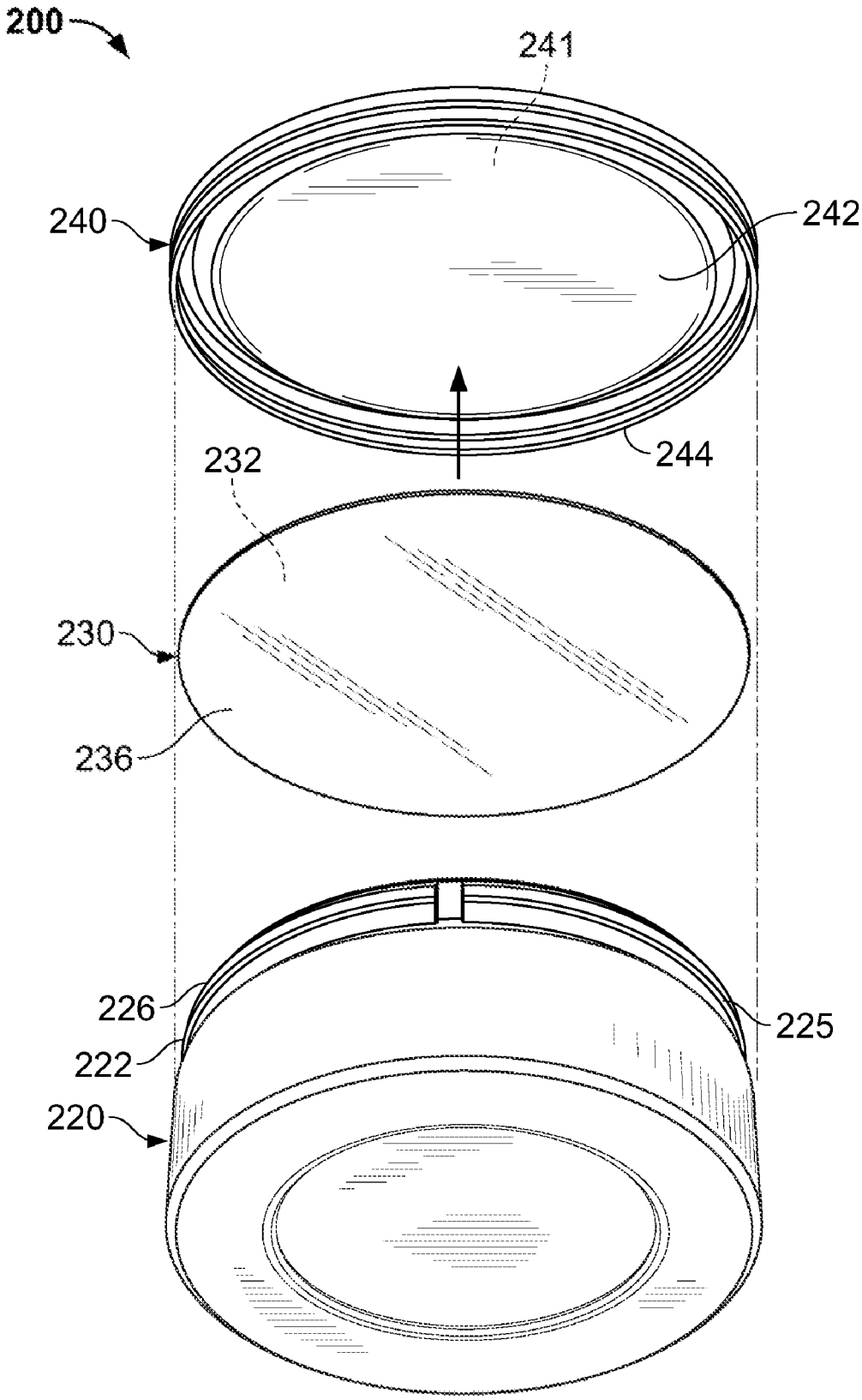
FIGS. 7A-B are perspective views of a tobacco product package device, in accordance with some embodiments.
Figure 7B:
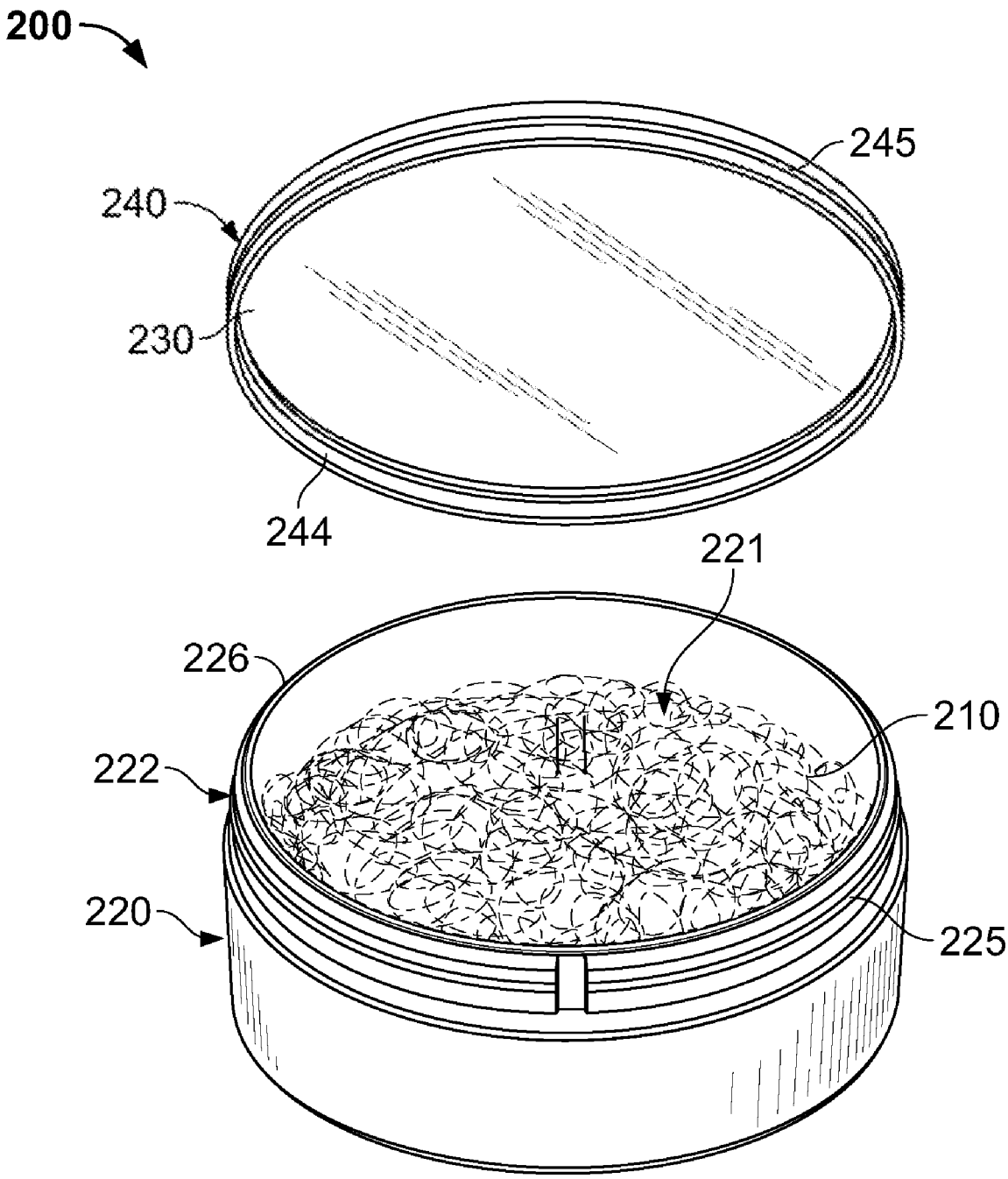

Referring now to FIGS. 7A-B, other embodiments of a tobacco product package device 200 can include a gasket 230 that is different from the previously described gasket 130. For example, in this embodiment, the gasket 230 comprises a liner that is engaged with an interior surface 242 of the lid 240 (e.g., affixed to the interior surface 242 using an adhesive, secured against the interior surface 242 using a locking bead that engages the outer perimeter of the liner, or the like). The liner 230 can include a generally flat, disc-shaped structure that abuts with the container 220 when the lid 240 is mated with the container 220. Similar to previously described embodiments, the gasket 230 of tobacco product package device 200 can be used to improve product freshness and other desirable product qualities both during shelf life and during consumer use. The gasket 230 may serve as a moisture barrier that inhibits the egress of the moisture from the container 220 (or the ingress of the moisture into the container 220) when the lid 240 is joined with the container 220.

In this embodiment, the container 220 is similar to the previously described container 120 (refer to FIGS. 2 and 4). For example, the container 220 has a generally cylindrical shape and includes a base and a cylindrical side wall that at least partially defines an interior space 221 (FIG. 7B). The container 220 may comprise a material such as a polymer (e.g., polypropylene or the like), fiberboard, or metallic material that is suitable for storing tobacco products having one or more flavoring agents or volatile agents. In this embodiment, the container 220 comprises a moldable polymer material. Also, the lid 240 can have a construction that is similar to the previously described lid 140 (refer to FIGS. 2 and 3), except that the gasket 230 affixed to the lid 240 comprises the liner structure. Accordingly, the container 220 and lid 240 are configured to have a snap-fit engagement. The lid 240 may comprise a metallic material (e.g., aluminum, tin, stainless steel, or the like) that is formed to define a lid wall 241 and a skirt 244 extending from the circumference of the lid wall 241. Alternatively, the lid 240 can be formed from a polymer material such as polypropylene or the like. Similar to previously described embodiments, the skirt 244 includes a second bead 245 that mates with a first bead 225 of the connection rim 222 to releasably retain the lid 240 to the container 220, thereby enclosing the snuff tobacco 210 or other tobacco products in the closed package device 200.

Still referring to FIGS. 7A-B, the gasket 230 can be engaged with the inner lid surface 242 so that the gasket 230 is position between the lid wall 241 and the connection rim 222 when the lid 240 mates with the container 220. For example, the liner can be affixed to the inner lid surface 242 using an adhesive (described below in connection with FIG. 9), retained against the inner lid surface 242 using a locking bead (not shown in FIGS. 7A-B) that engages the outer perimeter of the liner, or the like. As such, the metallic lid 240 can be press-fit with the container 220 so that the second bead 245 mates with the first bead 225 of the container 220, thereby urging the lid wall 241 toward the container 220. Because the lid wall 241 is urged toward the container 220, the gasket 230 can be at least partially compressed between the metallic lid 240 and the polymeric container 220 when the package device 200 is in the closed condition.

In this embodiment, the gasket 230 includes a liner structure having a diameter that is substantially similar to the diameter of the inner lid surface 242. As such, the liner structure substantially covers the inner lid surface 242 and can abut with the inside of the skirt 244. In these circumstances, the gasket 230 is urged against the connection rim 222 of the container 220 to provide a polymer-to-polymer interface when the lid 240 is joined with the container 220. The gasket 230 comprises a generally resilient material that is affixed to the inner lid surface 242, for example, by adhering the liner structure to the inner lid surface 242 (refer to FIG. 7B in which the gasket 230 is adhered to the inner lid surface 242). In this embodiment, the gasket 230 comprises a polyethylene sheet material that is die cut into the disc-shaped liner. In alternative embodiments, the gasket 230 may comprise another resilient material, such as polypropylene, sintered EVA, silicone, rubber, thermoplastic elastomers, pulp or cellulose, or the like.

The gasket 230 formed from the polyethylene material can be suitable for particular circumstances in which the tobacco product includes volatile agents that may impact other gasket materials. For example, in one embodiment, the tobacco product 210 (FIG. 7B) can include a flavoring agent that provides a wintergreen flavor. The wintergreen flavoring can be a volatile flavoring agent that is added to the tobacco. The wintergreen flavoring in the package device 200 can affect particular polymer materials, for example, by causing some polymer materials to swell or detach from bonded surfaces. Accordingly, the gasket 230 can be formed from the polyethylene material to reduce the effects from the wintergreen flavoring, thereby providing a gasket 230 that performs consistently even after prolonged exposure to volatile flavoring agents.

Similar to previously described embodiments, the gasket 230 of the package device 200 can serve as a moisture barrier to inhibit the egress of moisture from the package device 200 (and likewise to inhibit the ingress of moisture into the package device 200). For example, in the embodiment depicted in FIG. 7B the tobacco product 210 is in the form of a moist snuff tobacco product, and the gasket 230 can provide a barrier that inhibits the migration of moisture from the moist snuff tobacco product 210 and out the package device 200. Such a feature can improve the product freshness of the tobacco products that are enclosed in the tobacco product package device 200.

Also as previously described, the gasket 230 can be configured to provide a non-hermetic seal that permits a limited amount of gas exchange with the ambient air while maintaining control over the egress of moisture (from the tobacco product 210) out of the container 220. If some of the natural organic products found in the tobacco product 210 are susceptible to biological or chemical changes during the product shelf life, such a process may create byproduct gases. The non-hermetic seal provided by the gasket 230 permits at least some of the byproduct gases to escape from the container 220 even while the lid 240 is in the closed condition. In addition, the non-hermetic seal may permit a limited amount of ambient air (e.g., including oxygen) to ingress into the container 220. By providing this limited amount of gas exchange (e.g., egress of byproduct gases and ingress of oxygen), the gasket 230 can serve to reduce the likelihood of non-optimal flavors of the tobacco product when it is consumed.

Figure 8:
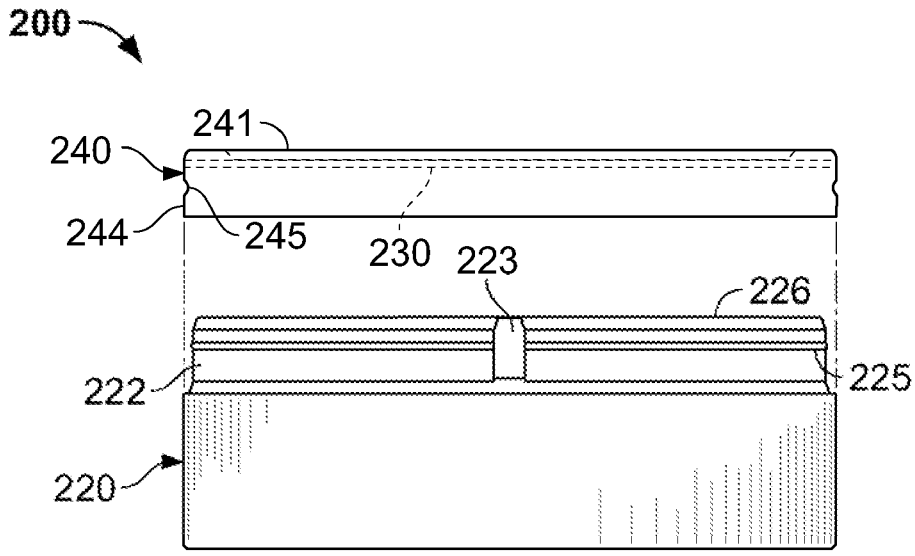
FIG. 8 is a section view of the tobacco product package device of FIGS. 7A-B.

Referring now to FIG. 8, some embodiments of the package device 200 may include one or more vent structures 223 arranged to at least partially control of the limited gas exchange provided by the non-hermetic seal of the gasket 230. Similar to previously described embodiments, the vent structures 223 can be positioned proximate to the connection rim 222 that mates with the lid 240. For example, each of the vent structures 223 comprises an indentation formed in the connection rim 222, which interrupts the first bead 225 of the connection rim 222 and extends toward an upper rim face 226. The vent structures 223 provide a path for gas exchange between the ambient air and the gasket-container interface (e.g., the interface between the gasket 230 and the container 220 in this embodiment). For example, when the lid 240 is mated with the container 220, some byproduct gases may pass from inside the container 220, pass the gasket 230, and out of the vent structures 223 (toward the ambient surroundings). As previously described, the vent structures 223 can be selected to at least partially control the amount of gas exchange. In addition, the vent structures 223 can be used to facilitate the snap-fit engagement between the container 220 and the lid 240. As the second bead 245 is pressed over the first bead 225, some air can escape out of the vent structure 223 to reduce the likelihood of trapping excessive air inside the container 220 (e.g., which may otherwise lead to excessive pressure that forces the lid 240 to readily disengage the container 220).

Figure 9:
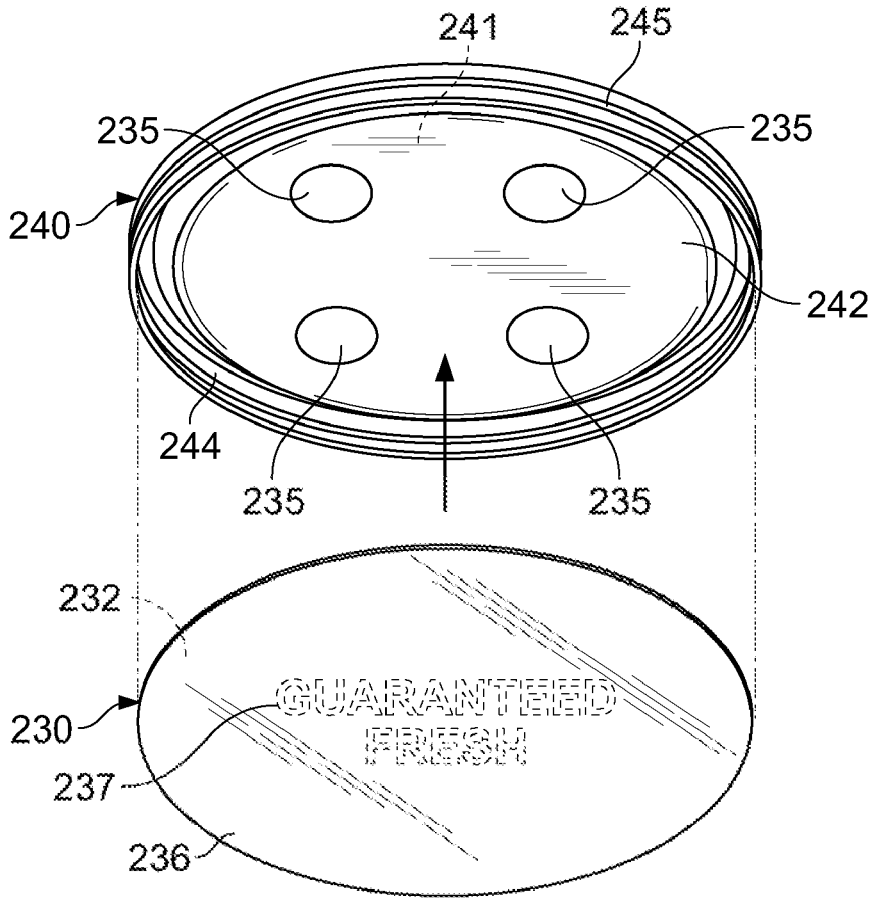
FIG. 9 is a perspective view of a lid and gasket of the tobacco product package device of FIGS. 7A-B.

Referring now to FIG. 9, the gasket 230 can be affixed to the inner lid surface 242, for example, by adhering the liner structure to the lid 240. The gasket 230 includes first surface 232 that is adhered to the inner lid surface 242 using adhesive deposits 235. As shown in FIG. 9, the gasket 230 also includes a second surface 236 arranged opposite of the first surface 232. The second surface 236 is configured to abut with the upper rim face 226 of the container 220 (FIG. 8) when the lid skirt 244 mates with the connection rim 222. Accordingly, the gasket 230 can provide a resilient liner structure that provides a moisture barrier between the metallic lid 240 and the polymeric container 220. As previously described, the moisture barrier can be used to enhanced the product freshness of the tobacco product 210 (FIG. 7B) contained in the package device 200.

In this embodiment, the gasket 230 includes a printed liner structure to provide indicia 237 that are viewable to a consumer when the lid 240 is opened. For example, the indicia 237 may include a message related to the tobacco product 210 (FIG. 7B) retained in the container. In another example, the indicia 237 may include date information, such as a suggest date before which the tobacco product 210 should be consumed for high quality flavor and freshness. The indicia 237 can be printed in a manner that isolates the markings from the tobacco product 210 in the container 210. For example, the indicia 237 may be printed on a first surface of a transparent sheet that is thereafter laminated to the polymer sheet material of the gasket 230. Thus, when the gasket 230 is die cut from the sheet material, the indicia 237 are separated from the tobacco product 210 in the container 220 by the transparent laminated sheet.

It should be understood that, in some embodiments, the liner structure of the gasket 230 can engage the inner lid surface 242 without the adhesive described in connection with FIG. 9. For example, the liner can be retained against the inner lid surface 242 using a locking bead formed in the skirt 244 that engages the outer perimeter of the liner. Thus, the first surface 232 of the gasket 230 can abut against the inner lid surface 242. In such circumstances, the gasket 230 can be at least partially compressed between the lid 240 and the container 220 when the package device 200 is in the closed condition.

Figure 10A:
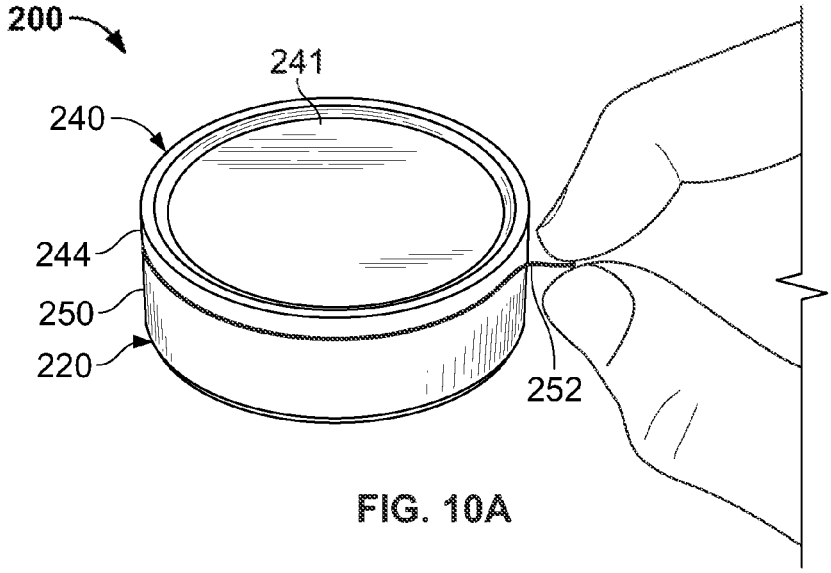
FIGS. 10A-C are perspective views showing consumer use of a tobacco product package device, in accordance with some embodiments.
Figure 10B:
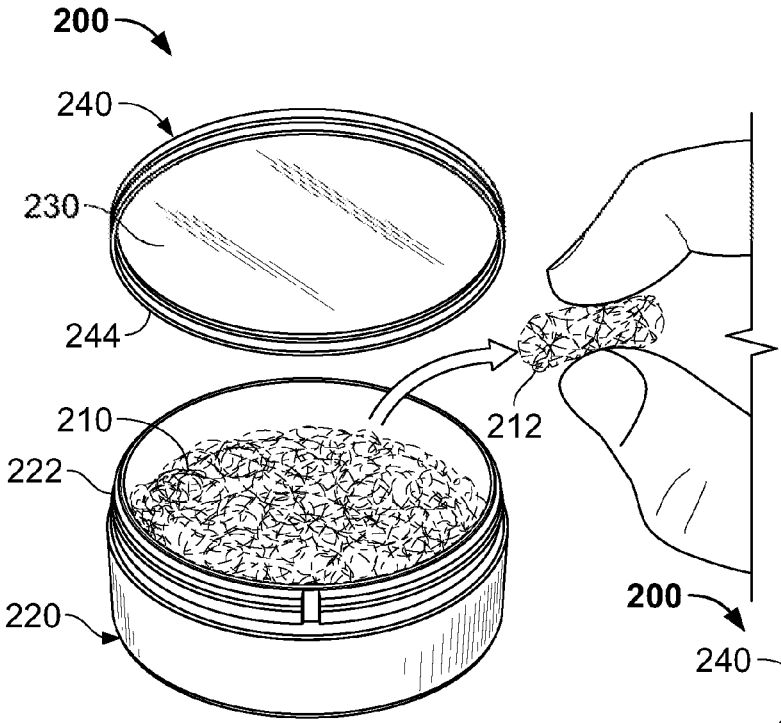
Figure 10C:
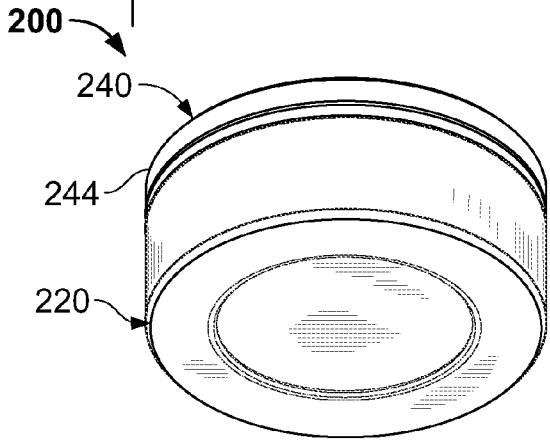

Referring to FIGS. 10A-C, in use, the tobacco product package device 200 can store the tobacco product 210 in conditions that maintain or enhance the product freshness and other desirable product qualities. As previously described, such storage conditions can be provided both during the product shelf life and during the period of consumer use. As shown in FIG. 10A, the tobacco product package device 200 can include a side label 250 that secures the container 220 and lid 240 together during the product shelf life. Similar to previously described embodiments, the side label 250 may comprise a paper label having an adhesive backing that retains the lid 240 in the closed condition (e.g., mated with the container 220). Alternatively, the side label 250 may comprise a polymer film that provides a side seal to serve as a supplemental moisture barrier during the product shelf life. The side label 250 can include a tear strip 252 that extends along the circumference of the package device 200 so that a consumer can pull upon the tear strip 252 to facilitate opening of the package device 200.

As shown in FIG. 10B, the consumer can separate the lid 240 from the container 220 so that the tobacco product package device 200 is in the opened condition. With the lid 240 removed, the consumer can access the tobacco product 210 stored in the container 220. In this embodiment, the tobacco product 210 is in the form of a moist snuff tobacco, and the consumer can take a portion 212 of the snuff tobacco for personal usage while the remaining portion of the tobacco product 210 is retained in the container 220.

As shown in FIG. 10C, after the consumer obtains a portion of the tobacco product 210, the consumer can return the tobacco package device 200 to the closed condition. For example, the user can press the lid 240 over the connection rim 222 of the container 220 so as to reengage the lid 240 with the container 220 and thereby enclosing the remaining tobacco product 210 in the package device 200. When the tobacco product package device 200 is returned to the closed condition, the gasket 230 (FIG. 10B) returns to an abutting relationship with the connection rim 222 of the container 220. Thus, when the lid 240 is returned to the closed condition Therefore, the gasket 230 can serve as a moisture barrier to enhance the product freshness both during the product shelf life (refer, for example, to FIG. 10A) and during the period of consumer use (refer, for example, to FIG. 10C).

Figure 11:
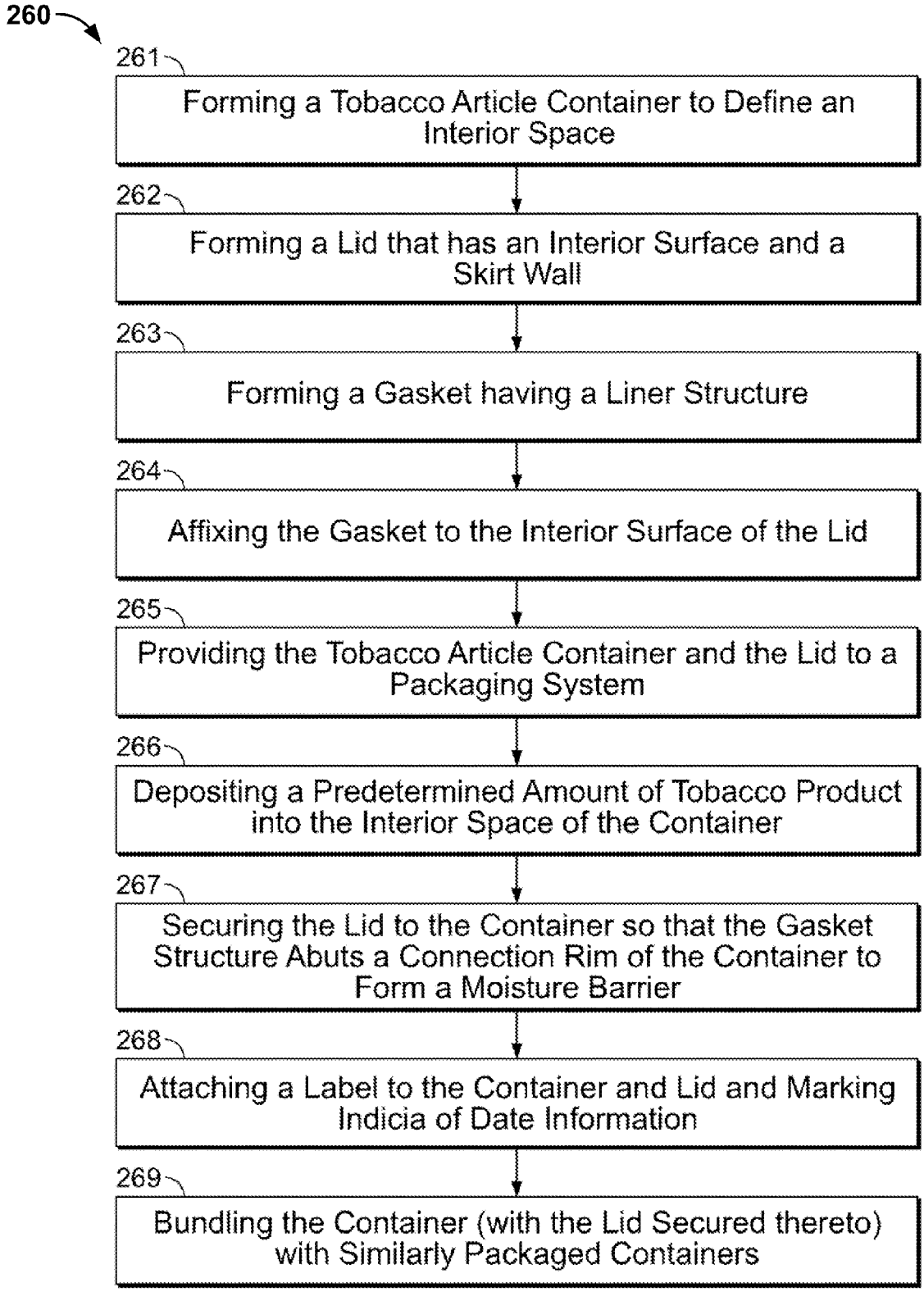
FIG. 11 is a diagram of a process for manufacturing a tobacco product package device, in accordance with some embodiments.

Referring now to FIG. 11, a process 260 for packaging tobacco products includes an operation 261 of forming a tobacco product container (e.g., container 220 depicted in FIGS. 7A-B and 8) to define an interior space that is accessible through an opening. The container 120 may comprise a material such as a polymer material (e.g., polypropylene or the like), fiberboard, or metallic material that is suitable for storing tobacco products. In this embodiment, the container 120 comprises a moldable polymer material (e.g., polypropylene or the like) so that the container 220 can be formed using an injection molding operation. The process 260 may also include an operation 262 of forming a lid (e.g., lid 240 depicted in FIGS. 7A-B and 8-9) that has an interior surface and skirt wall. Similar to previously described embodiments, the lid 240 can be formed from a metal material (e.g., aluminum, tin, stainless steel, or the like) using stamping process that deforms a metallic work piece into the desired shape including the lid wall 241 (having the interior surface 242) and the skirt 244.

The process 260 also includes an operation 263 for forming the gasket (e.g., the gasket 230 depicted in FIGS. 7A-B and 8-9). In this embodiment, the gasket 230 can be die cut into a relatively flat liner structure from a roll of polyethylene sheet material. For example, the polyethylene sheet material can include a thin inner layer comprising foamed polyethylene that is surrounded by a top and bottom layers of polyethylene film. The die-cut liner structure can have a disc shape with an outer diameter that fits within the skirt 244 of the lid 240. Alternatively, the die-cut liner structure can have a ring shape having a minor diameter that defines and inner opening and a major diameter that fits snugly within the skirt 244 of the lid 240. Such a die-cut formation process can be performed at high speeds to facilitate the mass production of the tobacco product package device 200. As an alternative to the polyethylene sheet material, the gasket 230 can be die cut from a roll of a different sheet material, such as polypropylene, sintered EVA, silicone, rubber, thermal plastic elastomers, pulp or cellulose, or the like.

As previously described, some embodiments of the gasket 230 may include indicia 237 (FIG. 9) viewable on the second surface 236 of the gasket 230. In such circumstances, the indicia 237 can be provided on the roll of sheet material before the liner structure is die cut to form the gasket 230. For example, the indicia 237 may be printed on a surface of a transparent sheet that is thereafter laminated to the second surface 236 of the polymer sheet material. Thereafter, the gasket 230 (with the indicia provided thereon) can be formed when the liner structure is die cut from the polymer sheet material having the printed laminate sheet thereon. The transparent sheet (having the indicia 237 printed thereon) may comprise a combination of PET and polyethylene such that a thin polyethylene film is provided on one side of the sheet so as to bond with the previously described liner structure formed from a roll of polyethylene sheet material. A similar transparent sheet (without any indicia printed thereon) comprising PET and polyethylene may be bonded to the opposite side of the previously described liner structure formed from a roll of polyethylene sheet material, which can strengthen the gasket 230 and inhibit occurrences of curling after the gasket is formed.

Still referring to FIG. 11, the process 260 may include an operation 264 of affixing the gasket 230 to the interior surface 242 of the lid 240. For example, as shown in FIG. 9, this operation 264 can be accomplished using an adhesive 235 that secures the first surface 232 of the gasket 230 to the interior surface 242. Alternatively, the gasket 230 can be friction fit with the inside of the lid skirt 244 so as to rest against the interior surface 242 of the lid 240.

In this embodiment the process 260 include an operation 265 of providing the tobacco product container and the lid to a packaging system. For example, the formed container 220 and the formed lid 240 (having the gasket 230 affixed thereto) can be input into a packaging system that conveys the components to a particular location for delivery of a tobacco product into the container 220. The process 260 also includes an operation 266 of depositing a predetermined amount of a tobacco product into the interior space 221 of the container 220. For example, the container 120 can be conveyed to portioning mechanism that delivers a selected portion of a tobacco product (e.g., the tobacco product 210 which may be in the form of snuff tobacco or the like) from a bin and into the container 220.

Still referring to FIG. 11, the process 260 includes an operation 267 of securing the lid 240 to the container 220 so that the gasket 230 abuts the connection rim 222 of the container 220. Similar to previously described embodiments, when the lid 240 is secured to the container 220, the gasket 230 forms a moisture barrier for the tobacco product package device 200 so as to inhibit the egress of moisture from the package device 200 (and likewise to inhibit the ingress of moisture into the package device 200). The process 260 may include an operation 268 of attaching a label to the container 220 and lid 240. For example, the operation 268 may include a labeler mechanism that affixes a side label 250 to the outer circumferential surface of the container 220 and the lid skirt 244. The operation 268 may also include providing indicia of date information, such as a packaging date, an expiration date, or a combination thereof. The date information can be printed onto the container 220, the lid 240, or the side label 250 so that the date information is viewable to a consumer. Similar to previously described embodiments, the process 260 may further include an operation 269 of bundling the container 220 (with the lid 240 secured thereto) with other packaged containers 220.

Accordingly, the tobacco product package devices 200 can be manufactured using methods that provide high reliability and cost efficiency. The operations for forming the tobacco product package devices 200 can provide consistent results for maintaining the freshness of snuff tobacco 210 or other tobacco products stored therein.

Figure 12A:
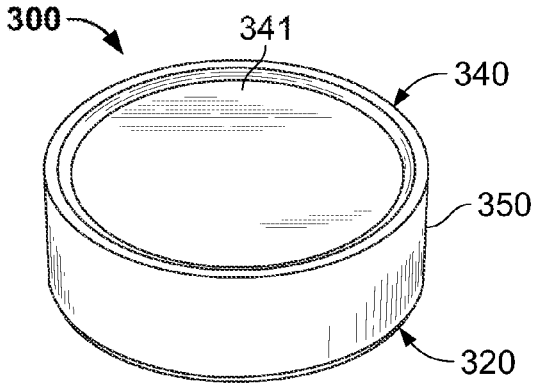
FIGS. 12A-C are perspective views of a tobacco product package device, in accordance with some embodiments.
Figure 12B:
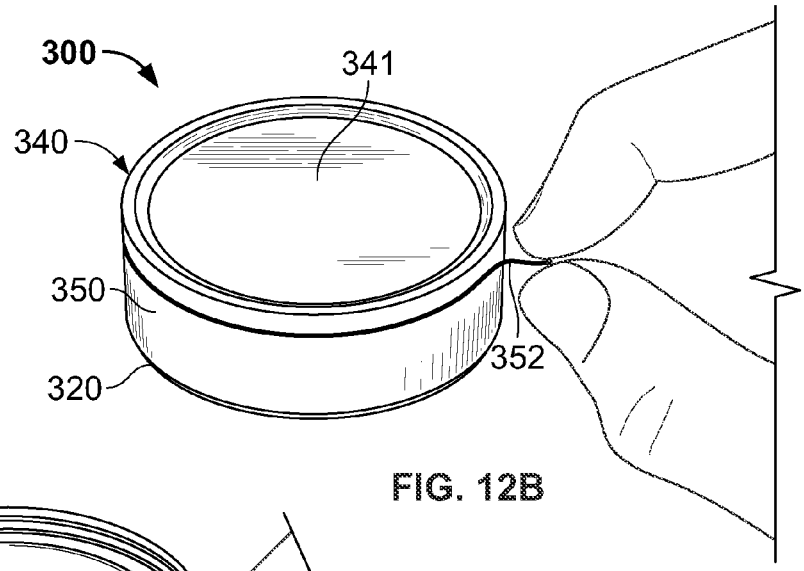
Figure 12C:
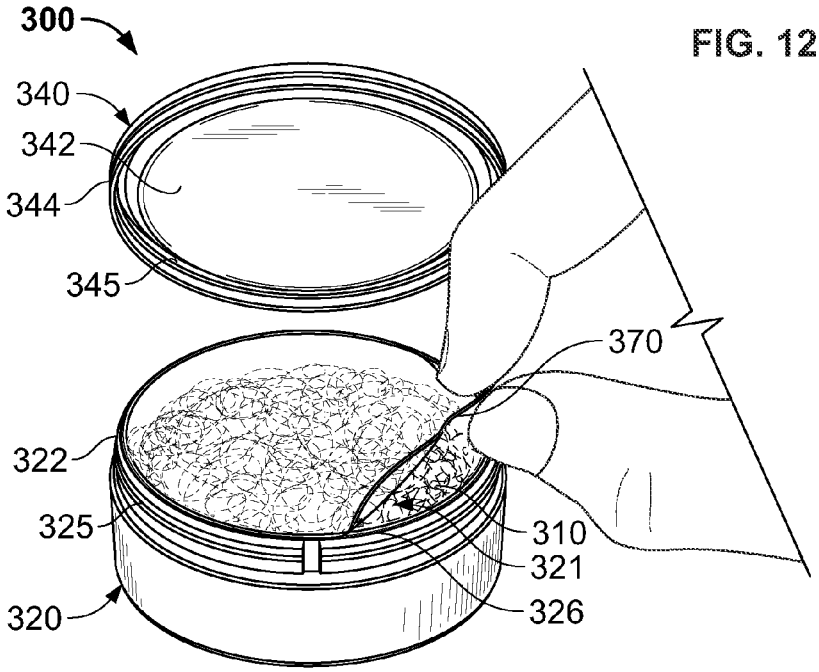

Referring now to FIGS. 12A-C, some embodiments of a tobacco product package device 300 may include features—in addition to or as an alternative to the gasket 130 or 230—that maintain or improve particular product qualities such as the freshness of the tobacco snuff or other tobacco products. These features can include, for example, a polymer side seal (FIGS. 12A-B), a peel-off top seal (FIG. 12C), or combination thereof.

In such embodiments, the tobacco product package device 300 may include a container 320 similar to the previously described container 120 (refer to FIGS. 2 and 4). For example, the container 320 has a generally cylindrical shape and includes a base and a cylindrical side wall that at least partially defines an interior space 321 (FIG. 12C). The container 320 may comprise a polymer material (e.g., polypropylene or the like), fiberboard material, or metallic material that is suitable for storing tobacco products having one or more flavoring agents.

Also, in these embodiments, the tobacco product package device 300 can include a lid 340 similar to the previously described lid 140 (refer to FIGS. 2 and 3). The container 320 and lid 340 are configured to have a snap-fit engagement. The lid 340 may comprise a metallic material (e.g., aluminum, tin, stainless steel, or the like) that is formed to define a lid wall 341 and a skirt 344 extending from the circumference of the lid wall 341. Alternatively, the lid 340 can be formed from a polymer material such as polypropylene or the like. Similar to previously described embodiments, the skirt 344 includes a second bead 345 that mates with a first bead 325 of the connection rim 322 (FIG. 12C) to releasably retain the lid 340 to the container 320, thereby enclosing the tobacco product 310 in the closed package device 300. In the particular embodiment depicted in FIG. 12C, the tobacco product 310 is in the form of a moist snuff tobacco product.

Still referring to FIGS. 12A-C, the tobacco product package device 300 can include a side label 350 that secures the container 320 and lid 340 together during the product shelf life. The side label 350 may comprise a polymer label substrate formed from polypropylene, polyethylene, PET, PVC, or the like. The polymer side label can be applied by using hot-melt, cold-melt, or pressure sensitive adhesives that secure to the outer circumferential surfaces of the container 320 and lid 340. As shown in FIG. 12B, the side label 350 can include a tear strip 352 that extends along the circumference of the package device 300 so that a consumer can pull upon the tear strip 352 to facilitate opening of the package device 300. Alternatively, the side label 350 can include a score line or other structure that facilitates separation of the side label 350 at a region near the interface of the container 320 and the lid 340.

The polymer side label 350 may serve as a moisture barrier during the product shelf life, which can enhance the product freshness when the tobacco product package device is opened by a consumer. In this embodiment, the polymer side label 350 can be implemented as an alternative to the previously described gasket 130 or 230. The polymer side label 350 can seal the exterior interface between the lid 340 and the container 320 so as to impede the ingress or egress of moisture therethrough, thereby preserving the product freshness and other desirable product characteristics of the tobacco product 310 contained in the package device 300. In some circumstances, the polymer side label 350 may not permit limited gas exchange for venting evolved gases, but such a side seal label 350 can be effective for tobacco product package devices 300 in circumstances where the level of evolved gases is minimal (e.g., where the product shelf life is short, where the tobacco products have little or no natural products that are likely to undergo sufficient biological or chemical changes, or the like). It should be understood that the side label 350 can be formed as a shrinkwrap construction that is applied over the container 320 and lid 340 (side, top, and bottom surfaces) and then heated to shrink fit over the outer surfaces of the container 320 and lid 340. In such circumstances, the shrinkwrap material may comprise a polymer film that is breathable to permit passage of certain gases (e.g., passage of some ambient air to provide oxygen exchange) while maintaining a moisture barrier.

As shown in FIG. 12C, the tobacco product package device 300 can include a peel-off top seal 370 to serve as a moisture barrier during the product shelf life. The peel-off top seal 370 comprises a film or substrate that is releasably affixed to an upper rim face 326 of the container 320. For example, the peel-off top seal 370 can be releasably affixed to the container 320 using heat-melting application or using of an adhesive. The peel-off top seal 370 can be die cut from a roll of flat sheet material so as to have an outer diameter that is substantially similar to the diameter of the upper rim face 326. The sheet material of the peel-off top seal 370 may comprise, for example, a polymer film, a foil substrate, a foil substrate having a polymer laminate layer, a paper substrate having a poly laminate layer, or the like. In such circumstances, the peel-off top seal 370 can serve as a moisture barrier to inhibit the egress of moisture from the package device 300 (and likewise to inhibit the ingress of moisture into the package device 300). For example, in the embodiment depicted in FIG. 12C, the tobacco product 310 is in the form of a moist snuff tobacco product, and the peel-off top seal 370 can provide a barrier that inhibits the migration of moisture from the moist snuff tobacco product 310 out of the package device 300 during the shelf life. Such a feature can improve the product freshness of the tobacco products that are enclosed in the tobacco product package device 300. In some embodiments, the peel-off top seal may comprise polymer film that is breathable to permit passage of certain gases (e.g., passage of some ambient air to provide oxygen exchange) while still providing the previously described moisture barrier.

During manufacture, some embodiments of the peel-off top seal 370 can be affixed to the upper rim face 326 of the container before the lid 340 can be fit over the peel-off top seal 370 and onto the container 320. In some embodiments, the side label 350 or an alternative paper side label can be arranged on the outer circumferential surfaces of the container 320 and lid 340 before the package device 300 is bundled for shipment. In use, a consumer can initially access the tobacco product 310 (FIG. 12C) by removing the lid 340 and peeling away the top seal 370. When the peel-off top seal 370 is removed, the tobacco product 310 may provide an aromatic effect pleasing to the consumer prior to the usage of the tobacco product 310.

In the embodiment depicted in FIG. 12C, the tobacco product package device 300 includes a lid 340 with no gasket (e.g., gasket 130 or 230) affixed thereto. Accordingly, the peel-off top seal 370 can be implemented as an alternative to the gasket 130 or 230 to provide a moisture barrier during the shelf life of the tobacco product package device 300. It should be understood from the description herein that, in some alternative embodiments, the peel-off top seal 370 can be implemented in combination with the gasket 130 or 230. In such circumstances, the peel-off top seal 370 can provide a moisture barrier during shelf life of the tobacco product package device 300, and the gasket 130 or 230 can provide a moisture barrier during the period of consumer use (e.g., when the package device 300 is repeatedly opened and closed).

Furthermore, the peel-off top seal 370 can be implemented as an alternative to, or in addition to, the polymer side label 350 described in connection with FIG. 12B. For example, the peel-off top seal 370 can be provided on a tobacco product package device 300 that includes a paper side label or no side label so that the peel-off top seal 370 serves as the only moisture barrier during the shelf life. Alternatively, the peel-off top seal 370 can be provided on a tobacco product package device 300 that includes the polymer side label 350 so as to provide a dual-layer moisture barrier during the shelf life of the package device 300.

A number of embodiments of the invention have been described. Nevertheless, it will be understood that various modifications, permutations, additions, and subcombinations thereof may be made without departing from the spirit and scope of the invention. Accordingly, other embodiments are within the scope of the following claims.

What is claimed is:

1. A tobacco product package device, comprising:

a polymeric container having a bottom wall, a generally cylindrical side wall that extends in an axial direction from the bottom wall toward a connection rim, and a top opening that is at least partially defined by the connection rim, the polymeric container defining an interior space that is in communication with the top opening;

a moist snuff tobacco product arranged in the interior space of the polymeric container;

a metallic lid that releasably engages the polymeric container to enclose the moist snuff tobacco product in the interior space, the metallic lid including a lid wall that is integral with a skirt, wherein the skirt provides a snap-fit engagement with the connection rim; and a resilient gasket affixed to an interior surface of the lid wall to provide a moisture barrier and a non-hermetic seal between the metallic lid and the polymeric container when the metallic lid is releasably engaged with the polymeric container.

2. The device of claim 1, wherein the moisture barrier inhibits egress of moisture from the moist snuff tobacco product and out of the container.

3. The device of claim 1, wherein the non-hermetic seal permits venting of byproduct gases from the polymeric container when the metallic lid is releasably engaged with the polymeric container.

4. The device of claim 1, wherein the resilient gasket abuts with the connection rim of the polymeric container when the metallic lid is releasably engaged with the polymeric container.

5. The device of claim 1, wherein the container includes one or more vent structures formed proximate the connection rim, the vent structures providing a path for gas exchange between ambient air and the interface between the gasket and the container.

6. The device of claim 5, wherein the skirt of the lid comprises a continuous bead that mates with a discontinuous bead on the connection rim of the container to provide the snap-fit engagement.

7. The device of claim 1, wherein the resilient gasket comprises a ring of polymer material deposited directly onto a perimeter channel of the interior surface of the lid wall.

8. The device of claim 7, wherein the resilient gasket comprises a plastisol composition that is cured on the interior surface of the lid wall.

9. The device of claim 1, wherein the resilient gasket comprises a liner structure that is engaged with the interior surface of the lid wall using at least one of an adhesive and a locking bead.

10. The device of claim 9, wherein the liner structure comprises a polyethylene sheet material having a shape selected from a disc and a ring.

11. The device of claim 9, wherein the liner structure comprises indicia that communicates information viewable when the lid is separated from the container.

12. The device of claim 1, wherein the moist snuff tobacco product comprises an organic material that undergoes biological or chemical changes while stored in the container to create byproduct gases in the container.

13. The device of claim 12, wherein the resilient gasket provides the non-hermetic seal such that a portion of the byproduct gases arising from the biological or chemical changes of the organic material stored in the container exit from the container along a path bordered by the resilient gasket.

14. The device of claim 13, wherein the skirt of the lid comprises a bead that mates with a bead of the connection rim of the container to provide the snap-fit engagement that urges the gasket into abutting contact with the connection rim of the container.

15. The device of claim 1, further comprising a side label attached to outer circumferential surfaces of the container and lid.

16. The device of claim 1, wherein the gasket includes a ring-shaped structure arranged on the interior surface of the lid wall so as to abut against the connection rim of the container.

17. A tobacco product package device, comprising:

a container defining an interior space and having a bottom wall, a generally cylindrical side wall that extends from the bottom wall toward a connection rim;

a tobacco product for oral consumption arranged in the interior space of the container;

a lid that encloses the tobacco product in the interior space of the container, the lid including a lid wall that is integral with a skirt, wherein the skirt is releasably engaged with the connection rim; and a resilient gasket in engagement with an interior surface of the lid wall to provide a moisture barrier and a non-hermetic seal between the lid and the container when the lid is secured to the container, the resilient gasket abutting with the connection rim of the container when the lid is secured to the container, wherein the moisture barrier inhibits the migration of moisture to and from the container when the lid is secured to the container, and wherein the non-hermetic seal permits gas exchange between ambient air and the interior space when the lid is secured to the container.

18. The device of claim 17, wherein the container includes one or more vent structures formed proximate the connection rim, the vent structures providing a path for gas exchange between ambient air and the interface between the gasket and the container.

19. The device of claim 18, wherein the resilient gasket comprises a ring of polymer material deposited directly onto a perimeter channel of the interior surface of the lid wall.

20. The device of claim 19, wherein the skirt of the lid comprises a continuous bead that mates with a discontinuous bead on the connection rim of the container to provide at least one of a snap-fit engagement and a slide-lock engagement.

21. The device of claim 17, wherein the tobacco product arranged in the interior space of the container comprises an organic product selected from the group consisting of chewing tobacco, moist snuff tobacco, and dry snuff tobacco.

22. The device of claim 21, wherein the resilient gasket provides the non-hermetic seal such that a portion of gases arising from biological or chemical changes of the organic product stored in the container exit from the container along a path bordered by the resilient gasket.

23. The device of claim 17, further comprising a side label attached to outer circumferential surfaces of the container and lid.

24. The device of claim 17, wherein the container comprises a polymer body and the lid comprises a metallic body, and wherein the metallic lid is press-fit into engagement with the polymer container so that a bead defined by the lid mates with a bead defined by the container to urge the lid wall toward the container.

25. The device of claim 17, wherein the non-hermetic seal permits venting of byproduct gases from the container while the lid is releasably engaged with the container.

26. The device of claim 17, wherein the gasket includes a ring-shaped structure arranged on the interior surface of the lid wall so as to abut against the connection rim of the container.

* * * * *